US007866774B2

(12) United States Patent
Ikeda et al.

(10) Patent No.: US 7,866,774 B2
(45) Date of Patent: Jan. 11, 2011

(54) IMAGE FORMING APPARATUS

(75) Inventors: Masami Ikeda, Osaka (JP); Kikunosuke Tsuji, Osaka (JP)

(73) Assignee: Kyocera Mita Corporation (JP)

( * ) Notice: Subject to any disclaimer, the term of this patent is extended or adjusted under 35 U.S.C. 154(b) by 193 days.

(21) Appl. No.: 12/020,776

(22) Filed: Jan. 28, 2008

(65) Prior Publication Data

US 2008/0284803 A1 Nov. 20, 2008

(30) Foreign Application Priority Data

Jan. 31, 2007 (JP) ..... 2007-021053
Apr. 12, 2007 (JP) ..... 2007-104633
Jun. 14, 2007 (JP) ..... 2007-157520

(51) Int. Cl.
*B41J 25/308* (2006.01)

(52) U.S. Cl. ..... 347/8

(58) Field of Classification Search ..... None
See application file for complete search history.

(56) References Cited

U.S. PATENT DOCUMENTS 5,239,941 A * 8/1993 Chibi ..... 74/502.2
5,668,581 A * 9/1997 Tsuji et al. ..... 347/37
2005/0140081 A1 6/2005 Sugimura et al.
2006/0066706 A1 * 3/2006 Nakashima ..... 347/104

FOREIGN PATENT DOCUMENTS

| | | |
|---|---|---|
| CN | 1637637 | 7/2005 |
| JP | 8-197790 | 8/1996 |
| JP | 2005-14343 | 1/2005 |
| JP | 2005-170547 | 6/2005 |
| JP | 2006-206309 | 8/2006 |

OTHER PUBLICATIONS

Machine translation for JP 2006-206309 A.*

* cited by examiner

*Primary Examiner*—Matthew Luu
*Assistant Examiner*—Justin Seo
(74) *Attorney, Agent, or Firm*—Gerald E. Hespos; Michael J. Porco

(57) ABSTRACT

An image forming apparatus is provided with a recording device for printing a recording medium, a conveyance unit arranged below the recording device to face the recording device and adapted to convey the recording medium, and an elevator for moving the conveyance unit upward and downward. The elevator includes an eccentric cam having an eccentrically located rotation axis line. The conveyance unit has a contact surface to be held in contact with the circumferential surface of the eccentric cam and is moved upward and downward by the rotation of the eccentric cam.

16 Claims, 19 Drawing Sheets

IMAGE FORMING APPARATUS

BACKGROUND OF THE INVENTION

1. Field of the Invention

The present invention relates to an image forming apparatus represented by a printer and a copier.

2. Description of the Related Art

Among image forming apparatuses, ink-jet printers have widely spread as home printers in recent years. An ink-jet printer is an image forming apparatus in which ink is ejected from a multitude of nozzles provided in a recording head as a recording device to print a sheet or the like as a recording medium. Ink-jet printers have become popular because of their advantages of small size, inexpensiveness and good quietness, and manufacturers provide a multitude of models nowadays. In recent years, there have been developed ink-jet printers adapted to office use, which include a recording head (line head) having substantially the same length as the width of sheets normal to a sheet conveying direction and are capable of high-speed printing of several tens of copies per minute, although the number of available models is still small.

Japanese Unexamined Patent Publication No. 2006-206309 discloses an example of the ink-jet printer as described above. The ink-jet printer includes a recording medium tray (sheet cassette), an image recording unit (recording device), a platen unit (conveyance unit) as a belt conveyor device and a discharge tray.

A plurality of recording media such as cut paper, OHP sheets or other sheets are accommodated while being stacked one above another on the recording medium tray and fed to the platen unit by a feeder. The platen unit includes an endless conveyor belt for conveying sheets, and a sheet fed from the recording medium tray is placed on the upper surface of this conveyor belt to be substantially horizontally conveyed.

The image recording unit is arranged above the platen unit to face it and includes inkjet head arrays for ejecting ink to the sheet corresponding to a plurality of colors of inks such as black, cyan, magenta and yellow. The ink head arrays extend in a main scanning direction, i.e. in a sheet width direction normal to a sheet conveying direction. Each inkjet head array ejects the ink in a gravitational direction, i.e. in a vertically downward direction from a multitude of nozzles.

The sheet being conveyed on the platen unit is printed with the inks ejected from the inkjet head arrays of the image recording unit arranged above in its process of conveyance. A plurality of colors of inks is successively ejected to the sheet to form a color image. The completely printed sheet is conveyed to the discharge tray as it is to be discharged.

Here, in the ink-jet printer constructed as above, nozzles are generally capped to prevent the drying and clogging of the ink ejection nozzles of the image recording unit. The ink-jet printer is further provided with an elevator for moving the platen unit (conveyance unit) upward and downward in order to cap the nozzles and deal with a jam having occurred during the conveyance of the sheet.

The apparatus of Japanese Unexamined Patent Publication No. 2006-206309 is provided with a platen driver as the elevator for moving the platen unit upward and downward. This platen driver includes four arms extending from a supporting shaft, and moves the platen unit upward and downward by rotating the arms while supporting the bottom surface of the platen unit with the tips of the arms.

However, since the relatively long arms extend from the supporting shaft in such an elevator for the platen unit, excessive torques might act on the arms themselves, the supporting shaft and a driving device such as a motor. This might possibly cause the arms and the motor to be deformed or broken. Therefore, problems of reducing image quality and shortening the life of the apparatus occur.

SUMMARY OF THE INVENTION

An object of the present invention is to, in an image forming apparatus provided with a conveyance unit for conveying a sheet and an elevator for moving the conveyance unit upward and downward, enable the conveyance unit to be smoothly moved upward and downward without generating excessive loads.

In order to accomplish this object, one aspect of the present invention is directed to an image forming apparatus comprising a recording device for printing a recording medium, a conveyance unit arranged below the recording device to face the recording device and adapted to convey the recording medium, and an elevator for moving the conveyance unit upward and downward. The elevator includes an eccentric cam having an eccentrically located rotation axis line. The conveyance unit has a contact surface to be held in contact with the circumferential surface of the eccentric cam and is moved upward and downward by the rotation of the eccentric cam.

The eccentric cam preferably includes a plurality of rotatable members at least partly projecting outward from the circumferential surface of the eccentric cam to be held in contact with the contact surface of the conveyance unit.

It is also preferable to further comprise a positioning member for positioning the conveyance unit relative to the recording device and a guiding mechanism for guiding vertical movements of the conveyance unit.

These and other objects, features, aspects and advantages of the present invention will become more apparent upon a reading of the following detailed description with reference to accompanying drawings.

DETAILED DESCRIPTION OF THE PREFERRED EMBODIMENTS

Hereinafter, embodiments of the present invention are described with reference to the accompanying drawings.

First Embodiment

Figure 1:
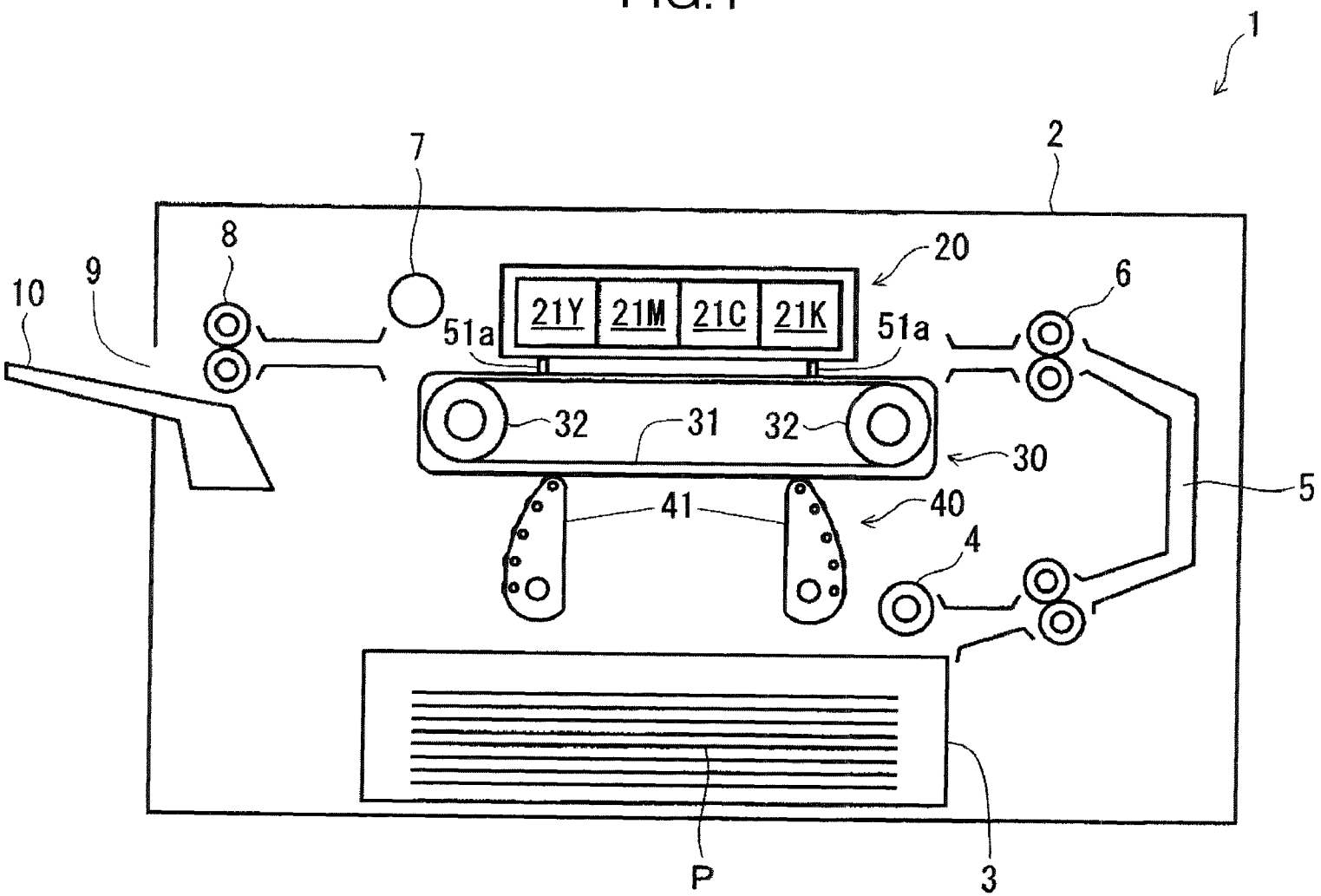
FIG. 1 is a diagrammatic front view in section of an ink-jet printer according to a first embodiment of the invention.

First of all, an image output operation is described while the construction of the image forming apparatus according to embodiments of the present invention is briefly described with reference to FIG. 1. FIG. 1 is a diagrammatic front view in section of an ink-jet printer 1 according to a first embodiment of the invention.

The printer 1 is provided with a recording device 20 accommodated in an apparatus main body 2 having a box structure and adapted to print a color ink image on a sheet P (an example of recording medium), a conveyance unit 30 arranged below the recording device 20 to face it and adapted to convey the sheet P, and an elevator 40 for moving the conveyance unit 30 upward and downward. The printer 1 is additionally provided with a sheet cassette 3, a sheet feeder 4, a sheet conveyance path 5, registration rollers 6, a dryer 7, discharge rollers 8, a discharge port 9 and a discharge tray 10.

The sheet cassette 3 is arranged at the bottom in the interior of the apparatus main body 2. A large number of sheets P are accommodated in the sheet cassette 3 while being stacked one above another. The sheet feeder 4 is arranged above and downstream of the sheet cassette 3 in a sheet conveying direction. The sheet P is fed to a right-up side of the sheet cassette 3 in FIG. 1 by this sheet feeder 4.

The sheet conveyance path 5 is a path for conveying the sheet P from the sheet cassette 3 to the recording device 20 and the conveyance unit 30, and the registration rollers 6 are disposed at an intermediate position. The sheet P fed from the sheet cassette 3 reaches the registration rollers 6 through the sheet conveyance path 5. The registration rollers 6 convey the sheet P to the conveyance unit 30 in synchronism with an ink ejecting operation performed by the recording device 20 while correcting the oblique feed of the sheet P.

The conveyance unit 30 includes an endless conveyance belt (turning belt) for conveying the sheet P and a pair of rollers 32 on which the conveyance belt 31 is mounted. The rollers 32 are rotatably supported on a first side plate 301 and a second side plate 302 (see FIG. 2) arranged to face each other. One of the pair of rollers 32 is a drive roller, which is driven to rotate by an unillustrated driving mechanism. The other roller 32 is a driven roller. The conveyance belt 31 turns in a counterclockwise direction in FIG. 1 by the rotations of the rollers 32. The sheet P fed by the registration rollers 6 is placed on the upper surface of this conveyance belt 31 to be conveyed from right to left in FIG. 1.

The recording device 20 forms a color ink image on the sheet P in accordance with an image data signal which the printer 1 receives from an external computer (not shown) and representing characters, graphics or patterns. The recording device 20 is arranged above the conveyance unit 30 to face it. The spacing between the bottom surface of the recording device 20 and the upper surface (sheet conveyance surface) of the conveyance belt 31 is a very short distance (about 1 mm in this embodiment).

The recording device 20 includes four line-type inkjet heads 21 (hereinafter, referred to as line heads). The line heads 21 respectively extend in a sheet width direction normal to the sheet conveying direction, and are arranged in a row from an upstream side to a downstream side along the turning direction of the conveyance belt 31 as shown in FIG. 1. The four line heads 21 are a black line head 21K, a cyan line head 21C, a magenta line head 21M and a yellow line head 21Y in this order from the upstream side.

Four unillustrated ink tanks are provided in correspondence with the line heads 21 of the respective colors at suitable positions in the apparatus main body 2. The inks of the respective colors are suitably supplied from these ink tanks to the line heads 21K, 21C, 21M and 21Y via supply tubes (not shown).

The respective line heads 21K, 21C, 21M and 21Y of the recording device 20 eject the inks toward the sheet P placed on the upper surface of the conveyance belt 31 in accordance with the information of the image data received from the external computer. The inks of the respective colors are successively ejected from the corresponding line heads 21K, 21C, 21M and 21Y at specified timings while the conveyance belt 31 is turned, whereby a color ink image, in which the inks of four colors, i.e. black, cyan, magenta and yellow are superimposed, is formed (printed) on the sheet P on the surface of the conveyance belt 31.

Highly viscous inks in the nozzles are ejected from all ink ejection nozzles (not shown) of the respective line heads 21K, 21C, 21M and 21Y upon starting the printing after the recording device 20 was stopped for a long time, and are ejected from the ink ejection nozzles, whose ink ejection amounts are equal to or below a predetermined value, between printing operations, thereby preparing for a next printing operation. At this time, a cap (not shown) is held in contact with the respective line heads 21 and the inks are ejected to the cap. The waste inks ejected into this cap are sucked by a pump (not shown) after the cap is detached from the respective line heads 21 and fed to the waste ink tank (not shown) provided at the bottom of the rear surface of the conveyance unit 30 to be stored.

The elevator 40 is arranged below the conveyance unit 30 to move the conveyance unit 30 upward and downward. The elevator 40 moves the conveyance unit 30 upward and downward upon capping the nozzles to prevent the drying and clogging of the ink ejection nozzles of the recording device 20 and to deal with a jam having occurred on the conveyance belt 31.

The dryer 7 is arranged downstream of the conveyance unit 30 in the sheet conveying direction. The inks ejected to the sheet P from the recording device 20 are dried by the dryer 7.

The discharge rollers 8, the discharge port 9 and the discharge tray 10 are arranged downstream of the dryer 7. The sheet P having the printed inks dried by the dryer 7 is conveyed to left by the discharge rollers 8 and discharged onto the discharge tray 10 provided at the outer side of the left surface of the apparatus main body 2 through the discharge port 9, i.e. discharged to the outside of the apparatus.

Figure 2:
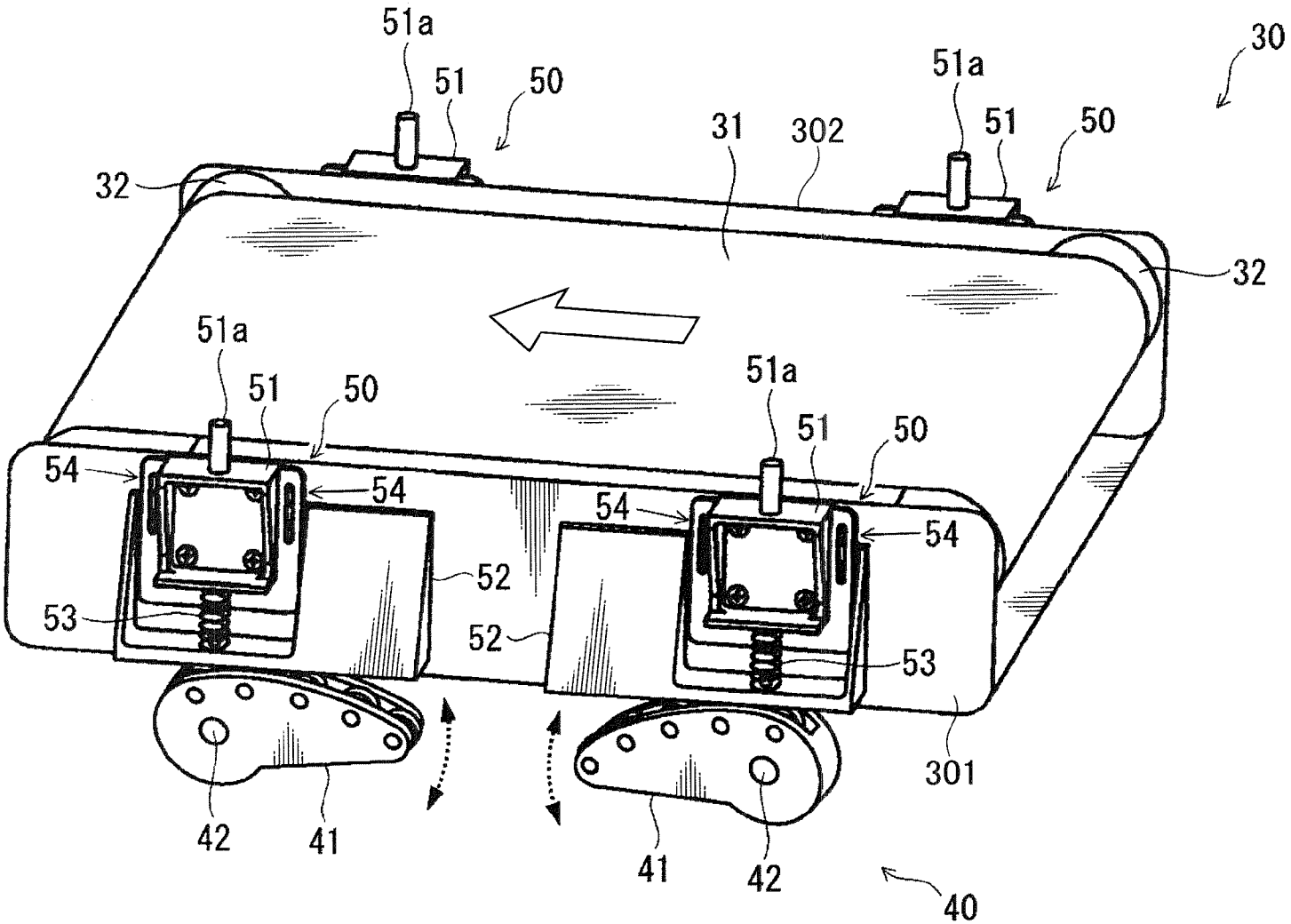
FIG. 2 is a perspective view showing a conveyance unit and an elevator according to the first embodiment.
Figure 3C:
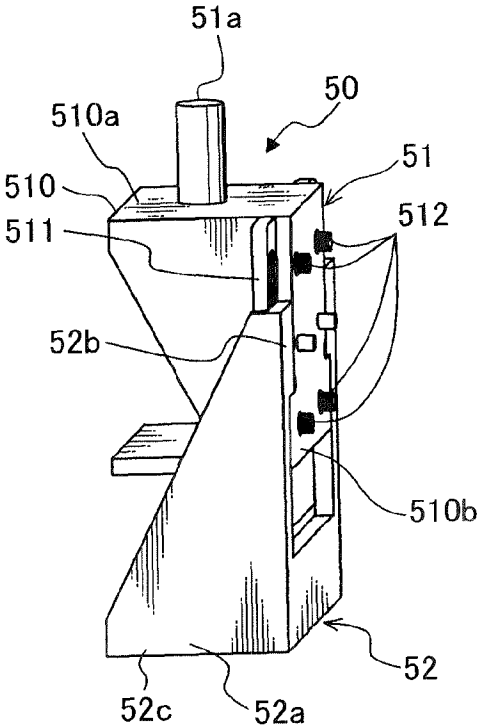
FIGS. 3A to 3C are perspective views showing a positioning member of the conveyance unit shown in FIG. 2.
Figure 3B:
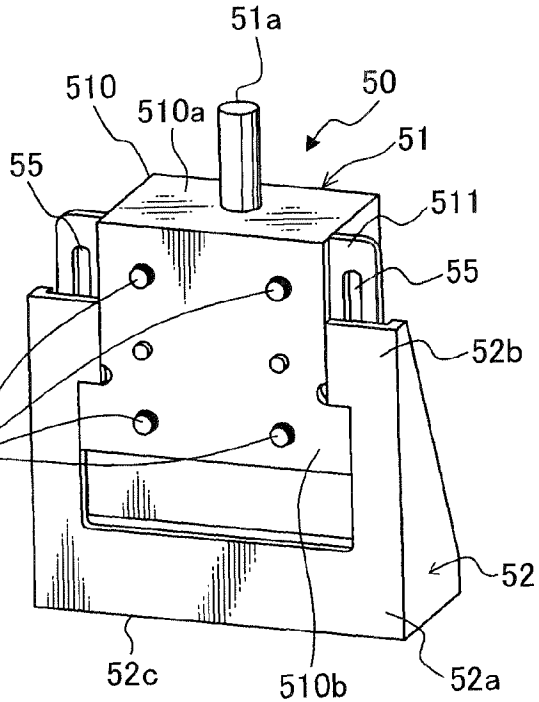
Figure 3A:
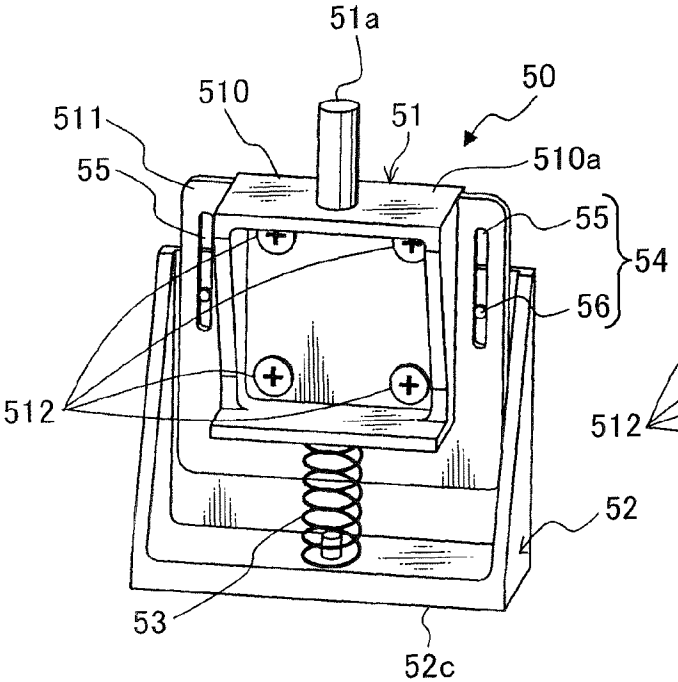
Figure 4:
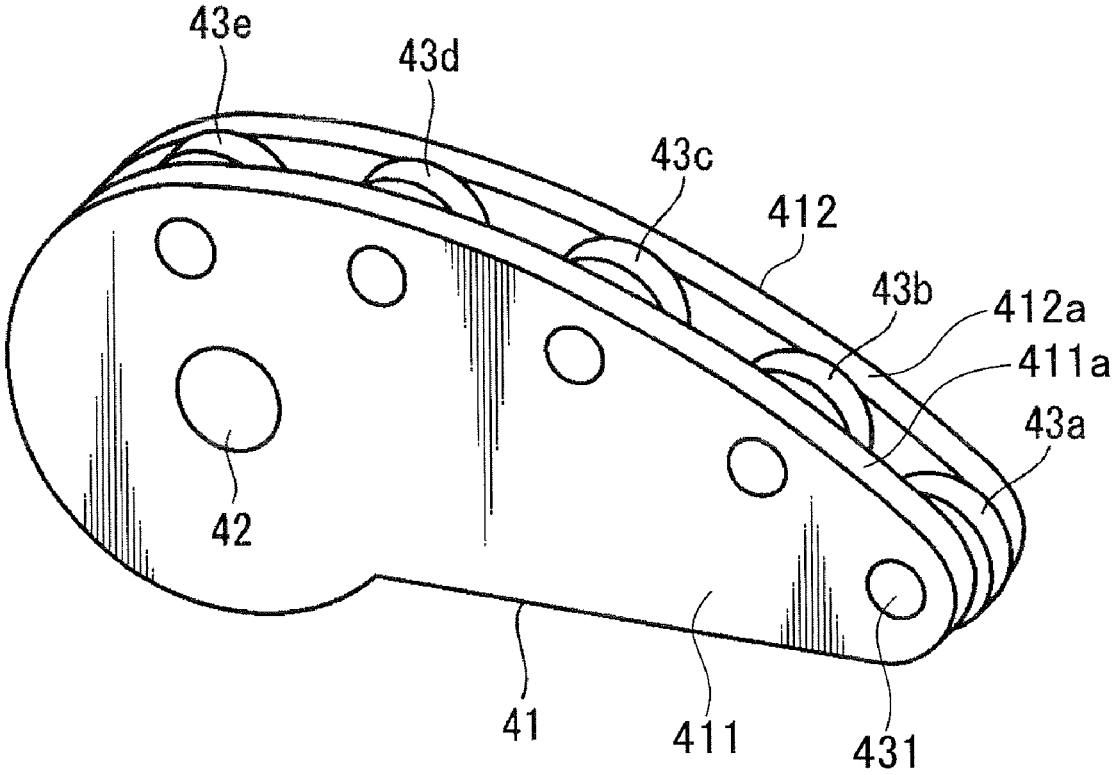
FIG. 4 is a perspective view showing an eccentric cam of the elevator shown in FIG. 2.
Figure 5:
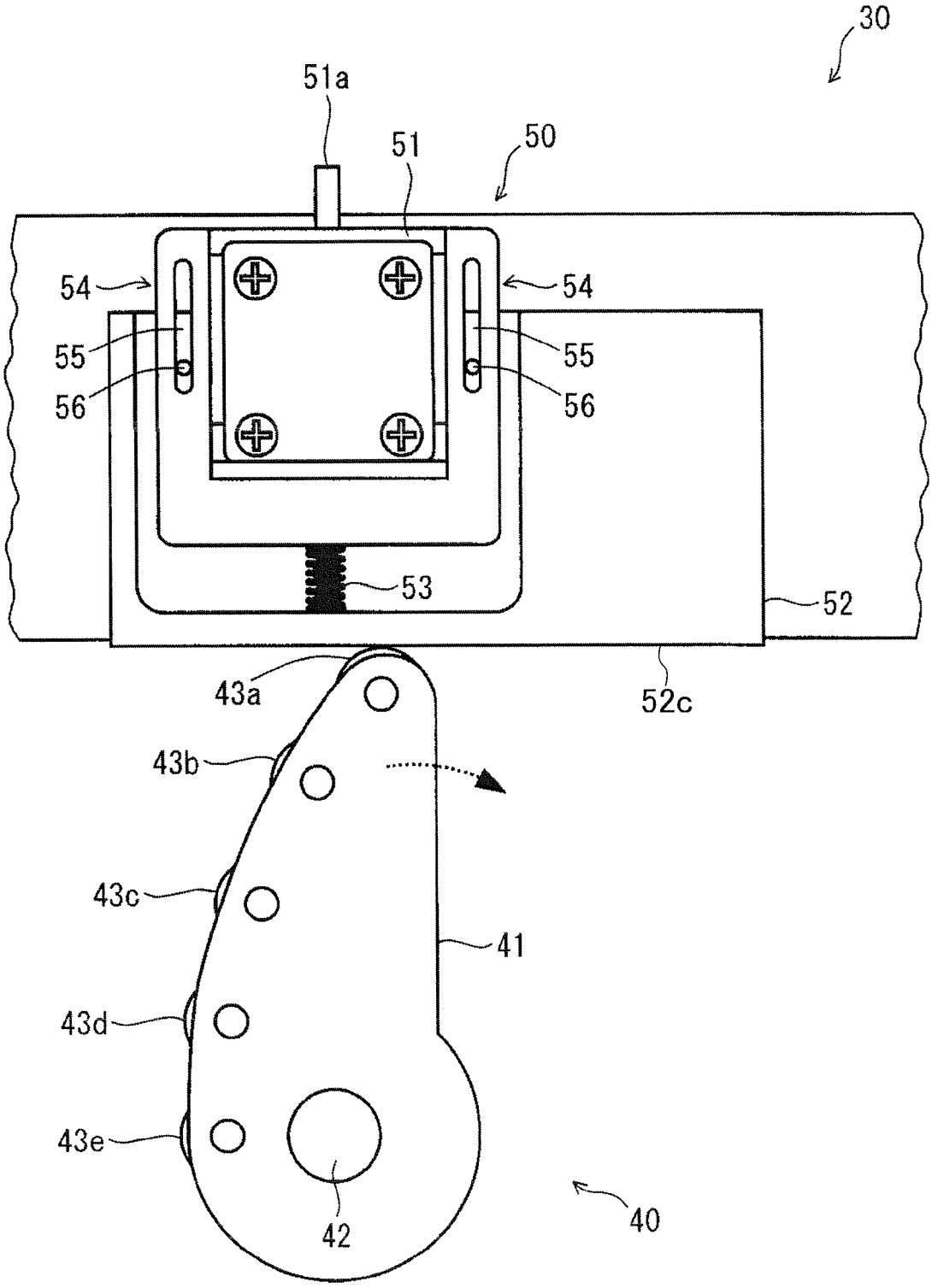
FIG. 5 is a partial enlarged front view of the elevator and its periphery shown in FIG. 2, FIGS. 6 to 10 are partial enlarged front views of the elevator and its periphery shown in FIG. 2 successively showing a state where the conveyance unit is gradually lowered.

Next, the detailed construction of the elevator 40 is described with reference to FIGS. 2 to 5 as well as FIG. 1. FIG. 2 is a perspective view showing the conveyance unit 30 and the elevator 40, FIGS. 3A to 3C are perspective views showing a positioning member 50 of the conveyance unit 30, FIG. 4 is a perspective view showing an eccentric cam 41, and FIG. 5 is a partial enlarged front view showing the elevator 40 and its periphery. FIGS. 1 and 5 show a state where the conveyance unit 30 is elevated by the elevator 40 and FIG. 2 shows a state where the conveyance unit 30 is lowered.

Prior to the description of the elevator 40, the construction of the conveyance unit 30 is described. As shown in FIGS. 1 and 2, the conveyance unit 30 has a box-shaped external configuration and is arranged substantially horizontally in the apparatus main body 2. The conveyance belt 31 is accommodated between the first and second side plates 301, 302 arranged to face each other, and the sheet conveyance surface of the conveyance belt 31 is exposed on the upper surface of the conveyance unit 30. The two rollers 32 extending in the sheet width direction are respectively arranged at the upstream and downstream sides of the first and second side plates 301, 302 in the sheet conveying direction. An upper plate for supporting the conveyance belt 31 and a lower plate are provided respectively at upper and lower parts between the first and second side plates 301, 302, whereby the conveyance unit 30 is in the form of a box-shaped frame.

The conveyance unit 30 includes supporting members 50 as shown in FIG. 2 on the first and second side plates 301, 302. The supporting members 50 are provided at two positions of the first side plate 301 (front side) and at two positions of the second supporting plate 302 (rear side), i.e. at a total of four positions of the conveyance unit 30. Each supporting member 50 includes a fixing portion 51, a sliding portion 52 (sliding member) and a spring 53 (biasing member). The fixing portion 51 and the sliding portion 52 are engaged by sliding mechanisms 54.

FIGS. 3A, 3B and 3C are perspective views of the supporting member 50 respectively from front, rear and lateral sides. The supporting member 50 of FIGS. 3A to 3C is shown such that the sliding portion 52 has a shorter transverse width as compared to the one shown in FIG. 2 in order to facilitate diagrammatic representation.

The fixing portion 51 of the supporting member 50 includes a main portion 510, a slide-contact plate 511 and a pin 51*a*. The main portion 510 has a flat top surface 510*a* where the pin 51*a* stands, and a flat rear surface 510*b* that serves as an attachment surface to the conveyance unit 30. The slide-contact plate 511 is a flat plate projecting outward from the opposite side walls of the main portion 510 and held in sliding contact with the sliding portion 52 (arms 52*b*). This slide-contact plate 511 is formed with a pair of left and right slits 55 extending straight in vertical direction. The pin 51*a* is so fixed to the main portion 510 as to project substantially vertically from the top surface 510*a*. The fixing portion 51 is fixedly mounted on the first or second side plates 301 or 302 by screws 512 such that the rear surface 510*b* thereof is in close contact with the outer surface of the first or second side plate 301 or 302.

The sliding portion 52 includes a main portion 52*a* located below the fixing portion 51, and a pair of arms 52*b* standing upward from the main portion 52*a*. The bottom surface of the main portion 52*a* serves as a contact surface 52*c* to be held in contact with the circumferential surface of the eccentric cam 41 to be described later. The arms 52*b* have flat portions held in sliding contact with the slide-contact plate 511, and guide pins 56 project from these flat portions. The guide pins 56 are fitted into the slits 55 to be guided.

Each sliding mechanism 54 is comprised of the guide pin 56 and the slit 55. The sliding portion 52 is so mounted on the fixing portion 51 as to be slidable upward and downward via the sliding mechanisms 54 provided at the left and right sides of the fixing portion 51. A space in which the sliding portion 52 is slidable is defined between the rear surface of the slide-contact plate 511 and the first or second supporting plate 301 or 302.

The spring 53 is disposed between the fixing portion 51 and the sliding portion 52. More specifically, the spring 53 is arranged between the bottom surface of the main portion 510 of the fixing portion 51 and the inner surface of the main portion 52*a* of the sliding portion 52 located below the bottom surface of the main portion 510. The spring 53 generates a stronger elastic force as the sliding portion 52 moves closer to the fixing portion 51.

As described later, the conveyance unit 30 is supported by the elevator 40 which comes into contact with the bottom surfaces (contact surfaces 52*c*) of the sliding portions 52 of the supporting members 50 fixed to the conveyance unit 30. When the sliding portions 52 are pushed up, strong elastic forces act on the springs 53 to elevate the fixing portions 51, i.e. the conveyance unit 30. When the conveyance unit 30 is elevated, the upper surfaces of the pins 51*a* come into contact with the bottom surface of the recording device 20 at a final stage, whereby the conveyance unit 30 is positioned relative to the recording device 20. As a result, a tiny clearance is defined between the bottom surface of the recording device 20 and the sheet conveyance surface that is the upper surface of the conveyance belt 31.

Here, all of the four pins 51*a* have to finally come into contact with the bottom surface of the recording device 20. A push-up force by the elevator 40 concentrates on the pin 51*a* having first come into contact with the bottom surface of the recording device 20 during an elevating movement until the other pins 51*a* come into contact. Such a localized push-up force can distort the conveyance unit 30. In order to prevent such a distortion, it may be thought to increase the rigidity of the conveyance unit 30. However, this brings about higher cost and a complicated construction. Accordingly, in this embodiment, the above localized push-up force is alleviated by disposing the springs 53.

If all the four pins 51*a* come into contact with the bottom surface of the recording device 20, the conveyance unit 30 and the recording device 20 can be perfectly kept in parallel to each other. Accordingly, the respective line heads 21K, 21C, 21M and 21Y and the sheet conveyance surface of the conveyance unit 30 can be perfectly kept in parallel without requiring fine adjustments by experience skill. Further, since the springs 53 function as shock absorbers even if the printer 1 is subjected to large vibration during transportation or in the event of an earthquake, the above balanced state can be maintained in any condition any time.

Next, the elevator 40 is described with reference to FIG. 4. The elevator 40 is arranged below the above described conveyance unit 30. The elevator 40 includes the eccentric cams 41 and a drive motor (not shown) for rotating the eccentric cams 41.

A total of four eccentric cams 41 are provided at positions corresponding to the four supporting members 50 provided on the first and second side plates 301, 302 of the conveyance unit 30. The circumferential surfaces of the eccentric cams 41 are held in contact with the bottom surfaces (contact surfaces 52*c*) of the sliding portions 52 of the supporting members 50.

The eccentric cams 41 are cams whose rotation axis lines (shaft portions 42) are eccentrically located. As shown in FIGS. 4 and 5, each eccentric cam 41 has the shaft portion 42 extending in the sheet width direction. This shaft portion 42 is connected to an unillustrated gear mechanism and the drive motor, and the eccentric cam 41 can rotate in forward and reverse directions about the shaft portion 42.

As shown in FIG. 4, the eccentric cam 41 includes a pair of holding plates 411, 412 and five bearings 43*a* to 43*e* (rotatable members) rotatably held between the holding plates 411, 412. The holding plates 411, 412 have peripheral edges 411*a*, 412*a* whose curvatures changes as the shaft portion 42 rotates. The curves of the peripheral edges 411*a*, 412*a* determine the arrangement mode of the bearings 43*a* to 43*e*. In other words, the respective bearings 43*a* to 43*e* are rotatably held by support shafts 431 located inwardly of the respective peripheral edges 411*a*, 412*a* by an equal distance and supported on the holding plates 411, 412. The axis lines of the support shafts 431 are parallel to the axial line of the shaft portion 42.

Parts of the outer circumferential surfaces of the respective bearings 43*a* to 43*e* project outward from the peripheral edges 411*a*, 412*a* of the holding plates 411, 412. A curve connecting the most projecting parts of the outer circumferential surfaces of the respective bearings is substantially parallel to the curves of the peripheral edges 411*a*, 412*a*, and serves as a cam surface. As shown in FIGS. 5 to 10, the projecting parts of such bearings 43*a* to 43*e* come into contact with the contact surface 52*c* of the sliding portion 52 of the supporting member 50.

The bearings 43*e* to 43*a* are arranged side by side in such an order as to be gradually distanced from the rotation axis line of the shaft portion 42. Specifically, the first bearing 43*a* is arranged at a most distant position from the rotation axis line of the shaft portion 42 at the leading end of the eccentric cam 41; the second bearing 43*b* is at a position closer to the rotation axis line than the first bearing 43*a*; and the third and fourth bearings 43*c*, 43*d* are successively arranged at closer positions; and the fifth bearing 43*e* is arranged at a closest position to the rotation axis line of the eccentric cam 41.

Figure 6:
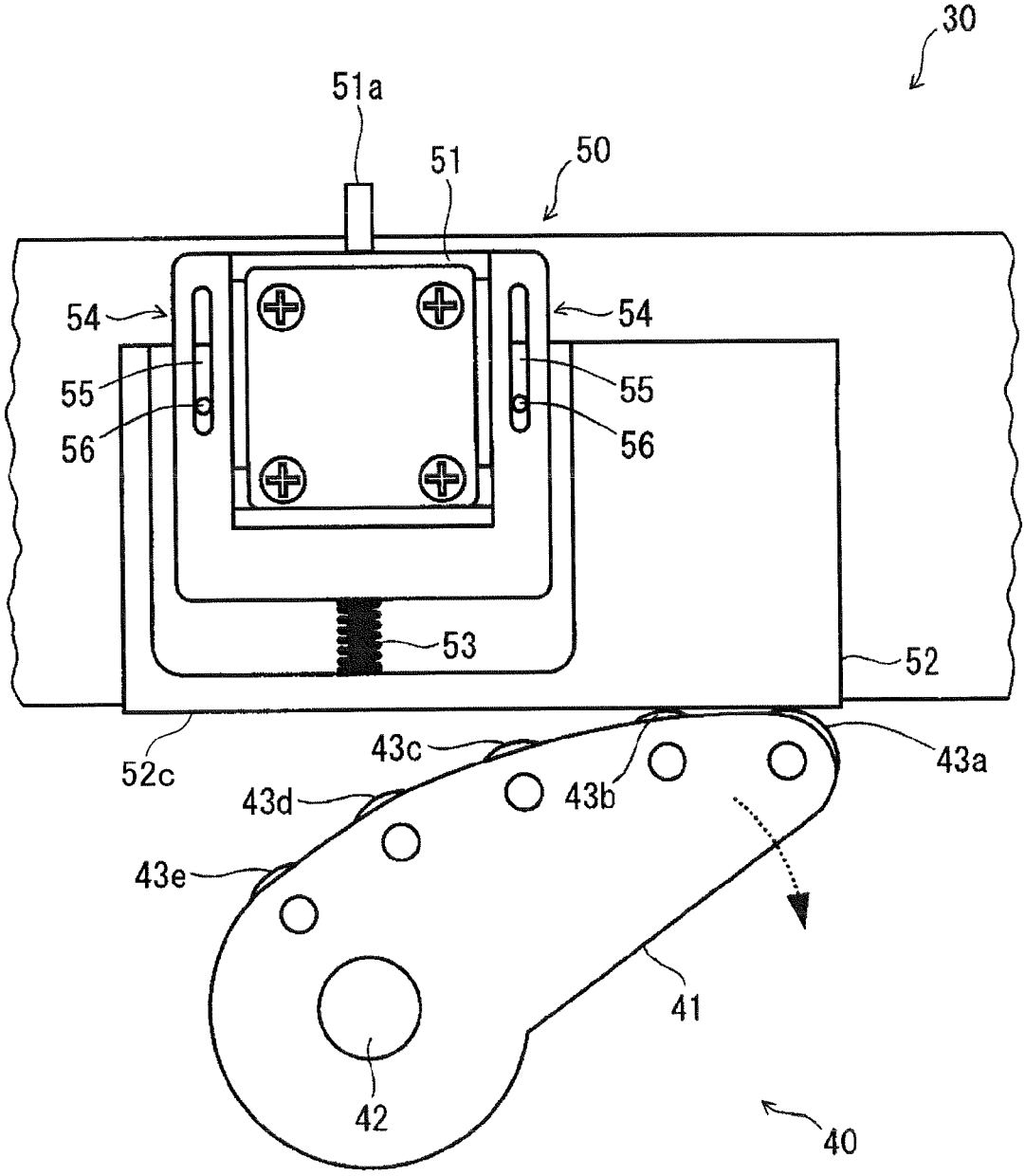

Next, the elevating and lowering movements of the conveyance unit 30 using the eccentric cams 41 of the elevator 40 are described with reference to FIGS. 5 to 10. FIG. 6 is a partial enlarged front view of the elevator 40 and its periphery similar to FIG. 5 showing a state attained by somewhat lowering the conveyance unit 30 from the state of FIG. 5. FIGS. 7 to 10 are also similar partial enlarged front views of the elevator 40 and its periphery, successively showing a state where the conveyance unit 30 is gradually lowered. It should be noted that FIG. 5 shows a state where the conveyance unit 30 is elevated to the uppermost position (position where the upper surfaces of the pins 51*a* of the supporting members 50 of the conveyance unit 30 are in contact with the bottom surface of the recording device 20) by the elevator 40.

In a normal printing state, a controller (not shown) of the printer 1 drives the elevator 40 to rotate the eccentric cams 41 as shown in FIG. 5, thereby moving the conveyance unit 30 to the uppermost position. In this state, a clearance suitable for printing is defined between the bottom surface of the recording device 20 and the upper surface of the conveyance unit 30 (see FIG. 1). Specifically, the clearance is set which is suitable to form an image on the surface of the sheet P by causing the inks to be ejected from the line heads 21K, 21C, 21M and 21Y while conveying the sheet P by the conveyance belt 31. At this time, the first bearings 43*a* of the eccentric cams 41 arranged at the most distant positions from the rotation axis lines of the shaft portions 42 are held in contact with the contact surfaces 52*c* of the sliding portions 52 of the supporting members 50 provided in the conveyance unit 30 from below.

The conveyance unit 30 is lowered by the elevator 40 upon capping the nozzles to prevent the drying and clogging of the ink ejection nozzles of the line heads 21K, 21C, 21M and 21Y of the recording device 20 or to deal with a jam having occurred on the conveyance belt 31.

At this time, the motor of the elevator 40 is driven by the controller to rotate the eccentric cams 41. In the case of lowering the conveyance unit 30, the eccentric cams 41 located at the upstream side in the sheet conveying direction of the conveyance unit 30 (shown by a white arrow in FIG. 2) rotate counterclockwise and the eccentric cams 41 located at the downstream side rotate clockwise when viewed from front. In other words, the respective eccentric cams 41 in a state where the projecting ends of the peripheral edges 411*a*, 412*a* (see FIG. 4) of the holding plates 411, 412 are facing the contact surfaces 52*c* rotate such that the sides of the peripheral edges 411*a*, 412*a* near the shaft portions 42 come to gradually face the contact surfaces 52*c*. As the eccentric cams 41 rotate, the first bearings 43*a* roll on the contact surfaces 52*c* and the eccentric cams 41 move as it they were sliding in horizontal planes of the contact surfaces 52*c* to start lowering the conveyance unit 30.

FIGS. 5 to 10 show the movement of the eccentric cam 41 located at the downstream side in the sheet conveying direction in FIG. 2. If the eccentric cam 41 is rotated clockwise to lower the conveyance unit 30 in the state of FIG. 5, the second bearing 43*b* arranged closer to the rotation axis line than the first bearing 43*a* comes into contact with the contact surface 52*c* of the sliding portion 52, i.e. the bottom surface of the conveyance unit 30 as shown in FIG. 6, following the first bearing 43*a*. In this way, the two adjacent bearings 43*a*, 43*b* have a period during which they are simultaneously in contact with the bottom surface of the conveyance unit 30.

Figure 7:
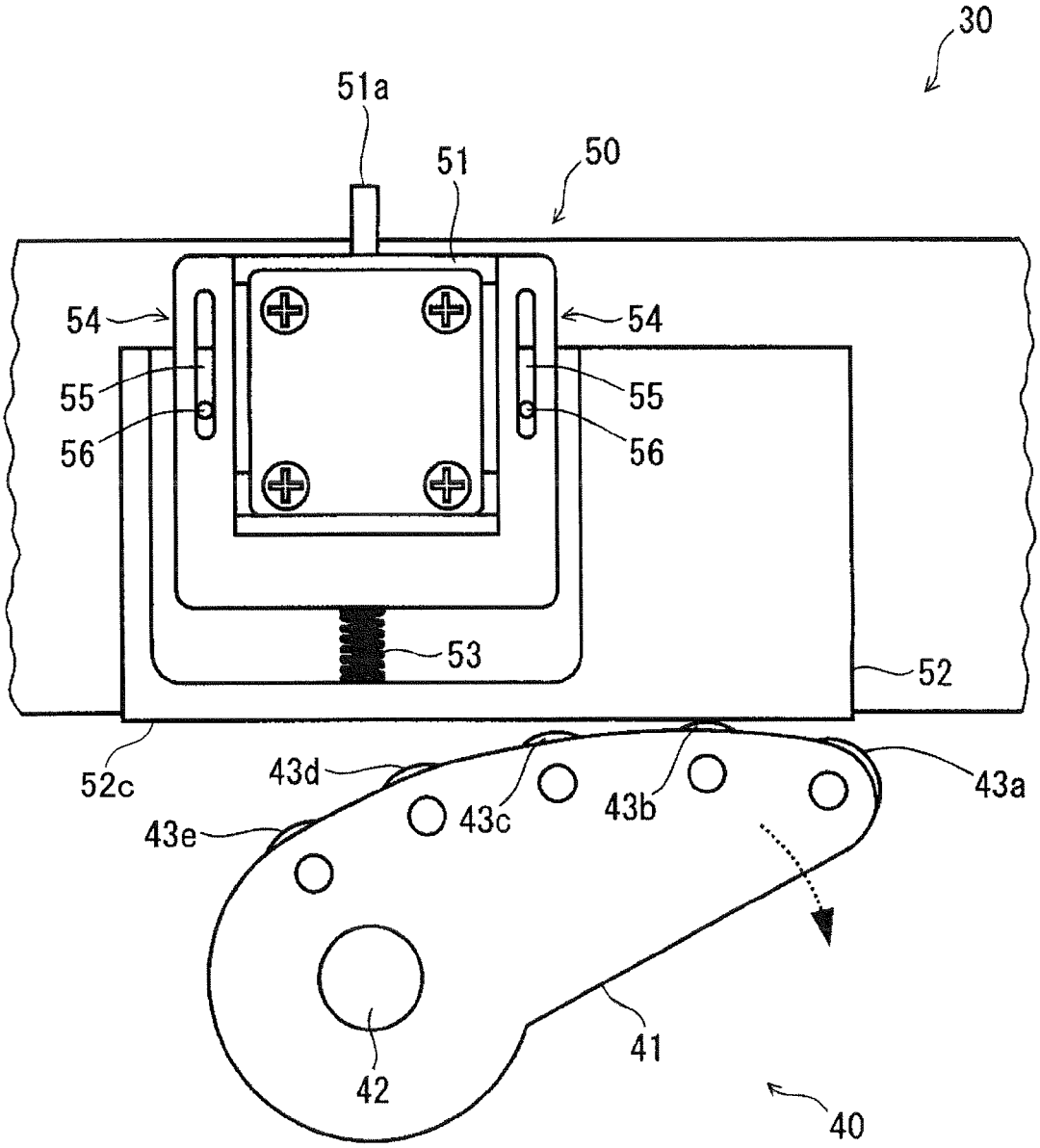

As the eccentric cam 41 further rotates, the second bearing 43*b* alone comes into contact with the bottom surface (contact surface 52*c*) of the conveyance unit 30 to support the conveyance unit 30 as shown in FIG. 7.

Figure 8:
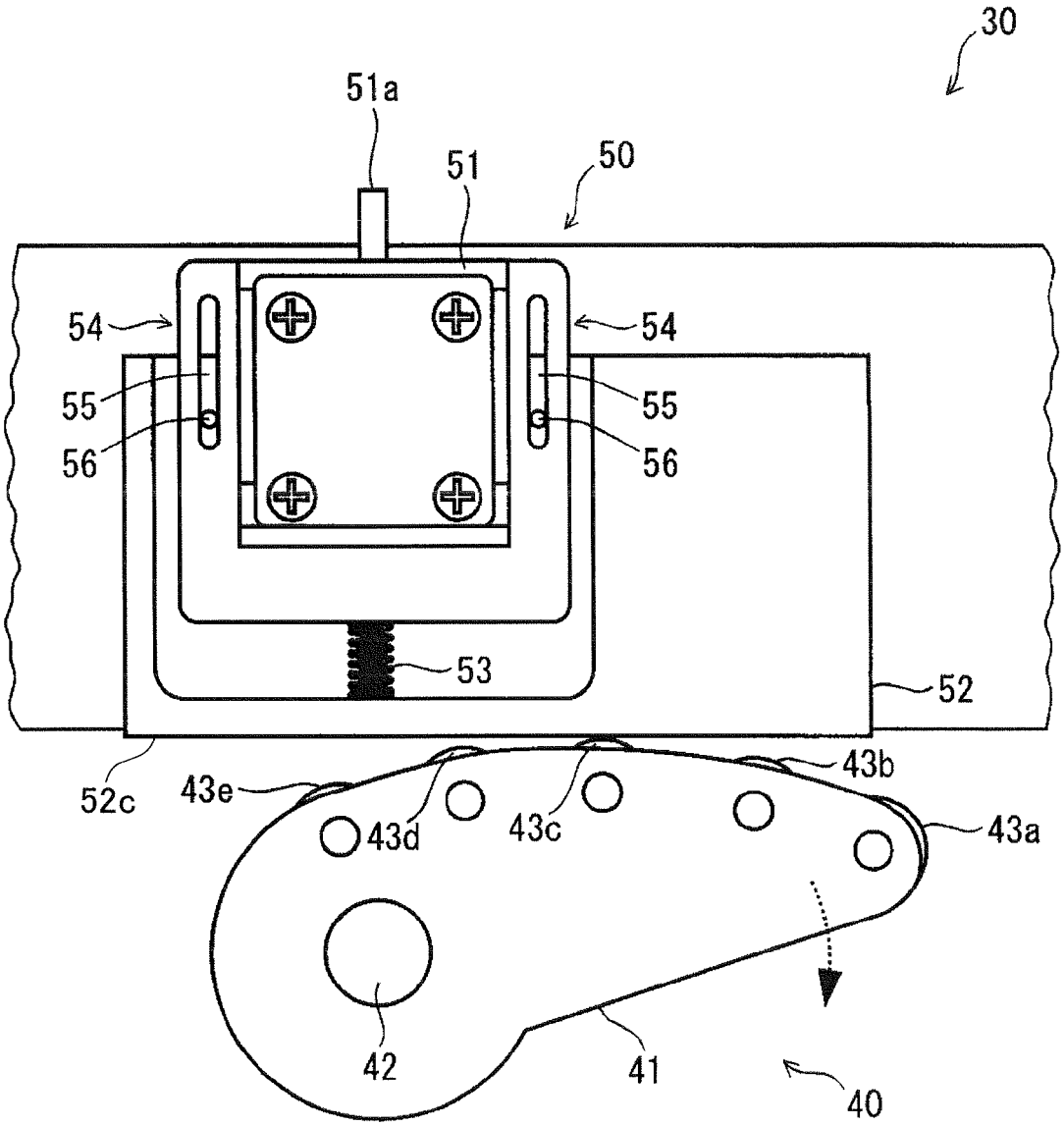
Figure 9:
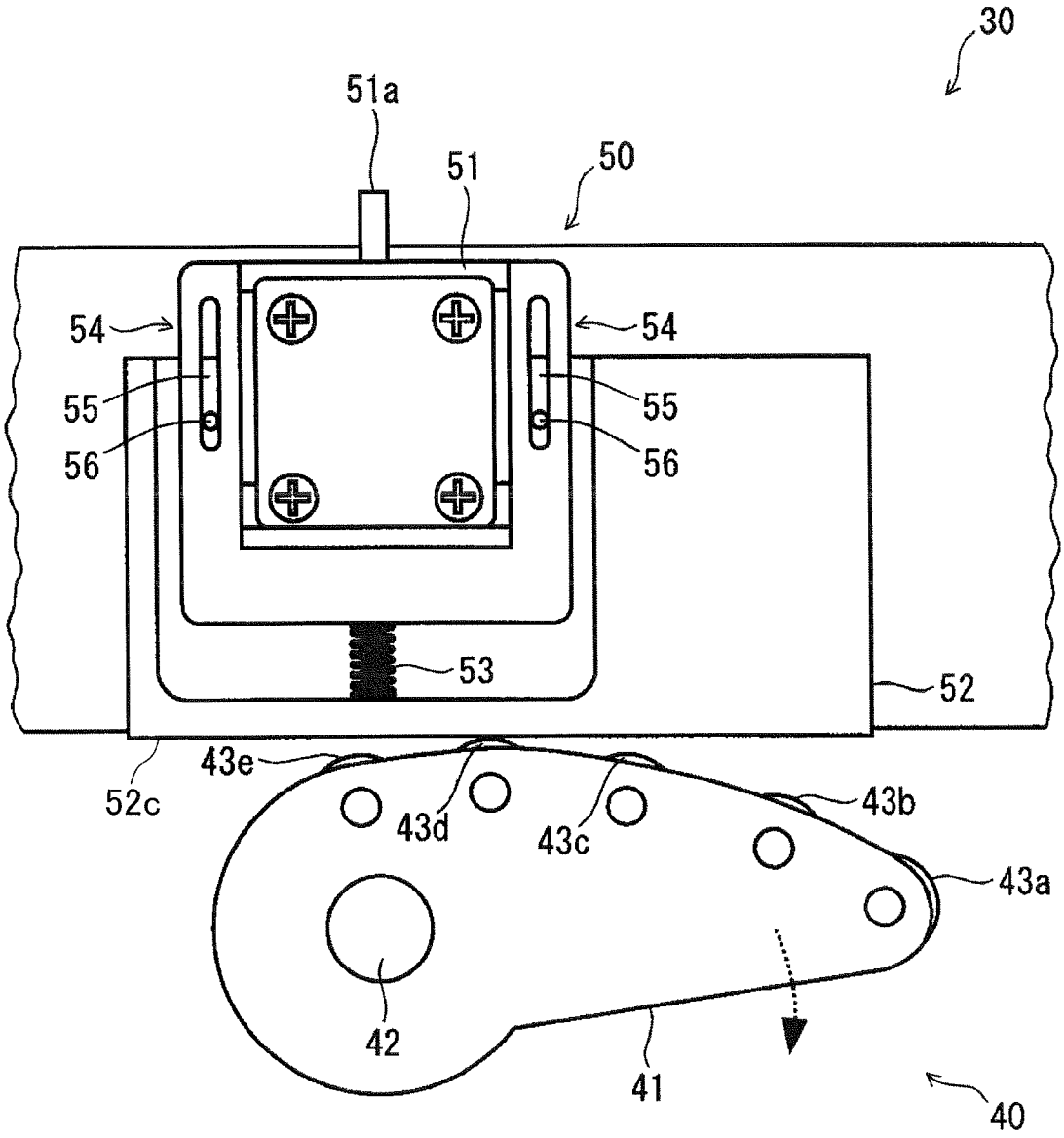

As the eccentric cam 41 continues to rotate, the third bearing 43*c* and the fourth bearing 43*d* successively come into contact with the bottom surface of the conveyance unit 30 respectively as shown in FIGS. 8 and 9 to support the conveyance unit 30. As in the case of the first and second bearings 43*a*, 43*b*, the two adjacent bearings 43*c*, 43*d* have a period during which they are simultaneously in contact with the bottom surface of the conveyance unit 30.

Figure 10:
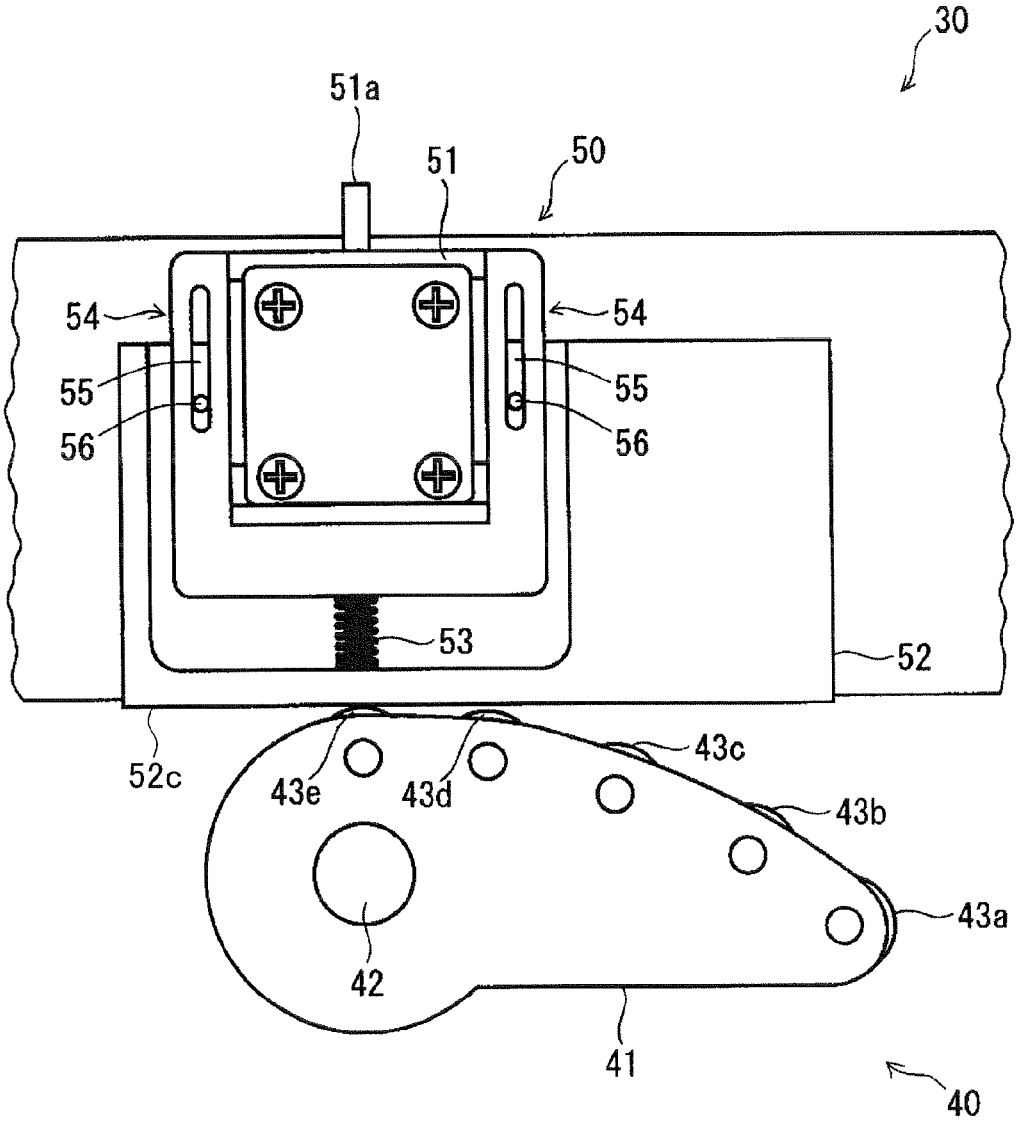

As shown in FIG. 10, the fifth bearing 43*e* arranged at the closest position to the rotation axis line of the eccentric cam 41 alone comes into contact with the bottom surface of the conveyance unit 30 to support the conveyance unit 30 at a final stage of the lowering of the conveyance unit 30. In this way, a relative wide operation space is defined between the recording device 20 and the conveyance unit 30.

Thereafter, in order to return the conveyance unit 30 to the position during normal printing, the conveyance unit 30 can be elevated up to the state shown in FIG. 5 by rotating the eccentric cam 41 in a reverse direction, i.e. counterclockwise direction in FIG. 10.

As described above, the printer 1 according to the first embodiment is provided with the recording device 20 for printing the sheet P, the conveyance unit 30 arranged below the recording device 20 to face it for conveying the sheet P and the elevator 40 for moving this conveyance unit 30 upward and downward. The elevator 40 includes the eccentric cams 41 having the eccentrically located rotation axis lines, holds the circumferential surfaces of the eccentric cams 41 in contact with the conveyance unit 30 (contact surfaces 52*c* of the sliding portions 52 of the supporting members 50) and moves the conveyance unit 30 upward and downward by the rotations of the eccentric cams 41.

Thus, the magnitudes of loads acting on the eccentric cams 41 themselves, the shaft portions 42 and the driving device such as the motor for rotating the eccentric cams 41 can be gradually and smoothly changed. This can suppress the sudden action of excessive loads upon starting the elevator 40. Accordingly, the deformation and breakage of the eccentric cams 41 and the motor can be prevented. As a result, the conveyance unit 30 can be smoothly moved upward and downward without generating excessive loads in the elevator 40, the durability life of the printer 1 can be improved and high-quality images can be formed.

Each eccentric cam 41 includes the bearings 43*a* to 43*e* as a plurality of rotatable members that at least partly project outward from the circumferential surface of the eccentric cam 41 to be held in contact with the conveyance unit 30. Thus, friction at contact portions of the eccentric cam 41 and the conveyance unit 30 can be reduced and the conveyance unit 30 can be smoothly moved upward and downward.

Since the plurality of bearings 43*a* to 43*e* are arranged in such an order as to be gradually distanced from the rotation axis line of the eccentric cam 41, the bearings 43*a* to 43*e* can successively come into contact with the conveyance unit 30 as the eccentric cam 41 is rotated.

Thus, the magnitudes of the loads acting on the eccentric cams 41 themselves, the shaft portions 42 thereof and the driving device such as the motor for rotating the eccentric cams 41 can be gradually and smoothly changed while frictions in the contact portions of the eccentric cams 41 and the conveyance unit 30 are reduced. Accordingly, the durability life of the printer 1 can be further improved and stability in the elevating and lowering movements of the conveyance unit 30 can be improved.

In the rotation process of each eccentric cam 41, two adjacent ones of the plurality of bearings 43*a* to 43*e* have the period during which they are simultaneously in contact with the conveyance unit 30. Thus, a state where at least one bearing is invariably in contact with the conveyance unit 30 can be created, thereby being able to prevent the direct contact of the conveyance unit 30 with the holding plates 411, 412 of the eccentric cams 41. Therefore, the conveyance unit 30 can be more smoothly moved upward or downward. As a result, the quality of the formed image can be improved while the durability life of the printer 1 is further improved.

Second Embodiment

Figure 11:
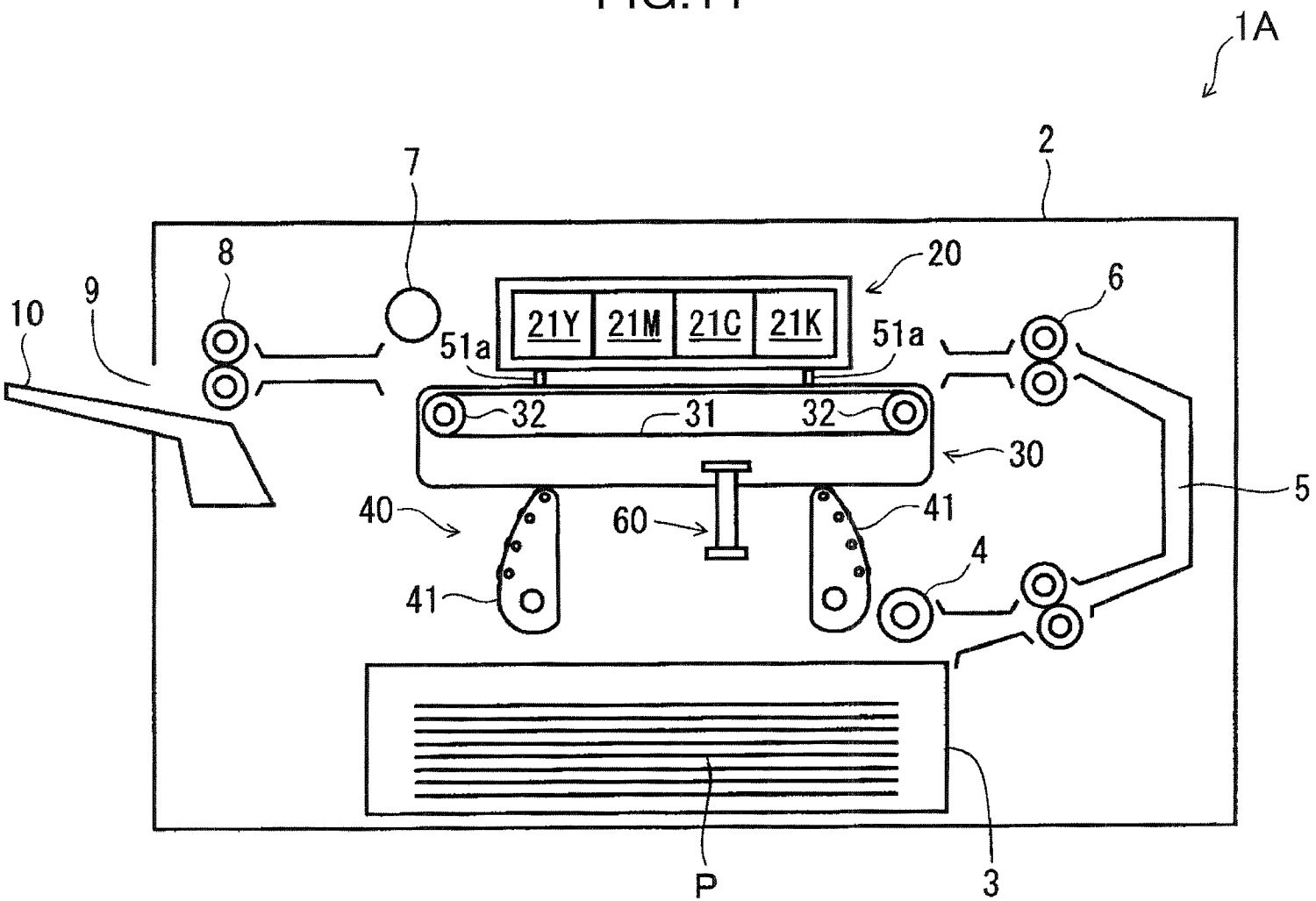
FIG. 11 is a diagrammatic front view in section of an ink-jet printer according to a second embodiment of the invention.

FIG. 11 is a diagrammatic front view in section of an ink-jet printer 1A according to a second embodiment of the present invention. A point of difference from the first embodiment is that guiding mechanisms 60 are provided to prevent displacements of the conveyance unit 30 in transverse direction upon moving the conveyance unit 30 upward and downward. Parts in FIGS. 11, 12 to 19 identified by the same reference numerals as in FIGS. 1 to 10 described above are identical and described either not at all or only briefly.

Figure 12:
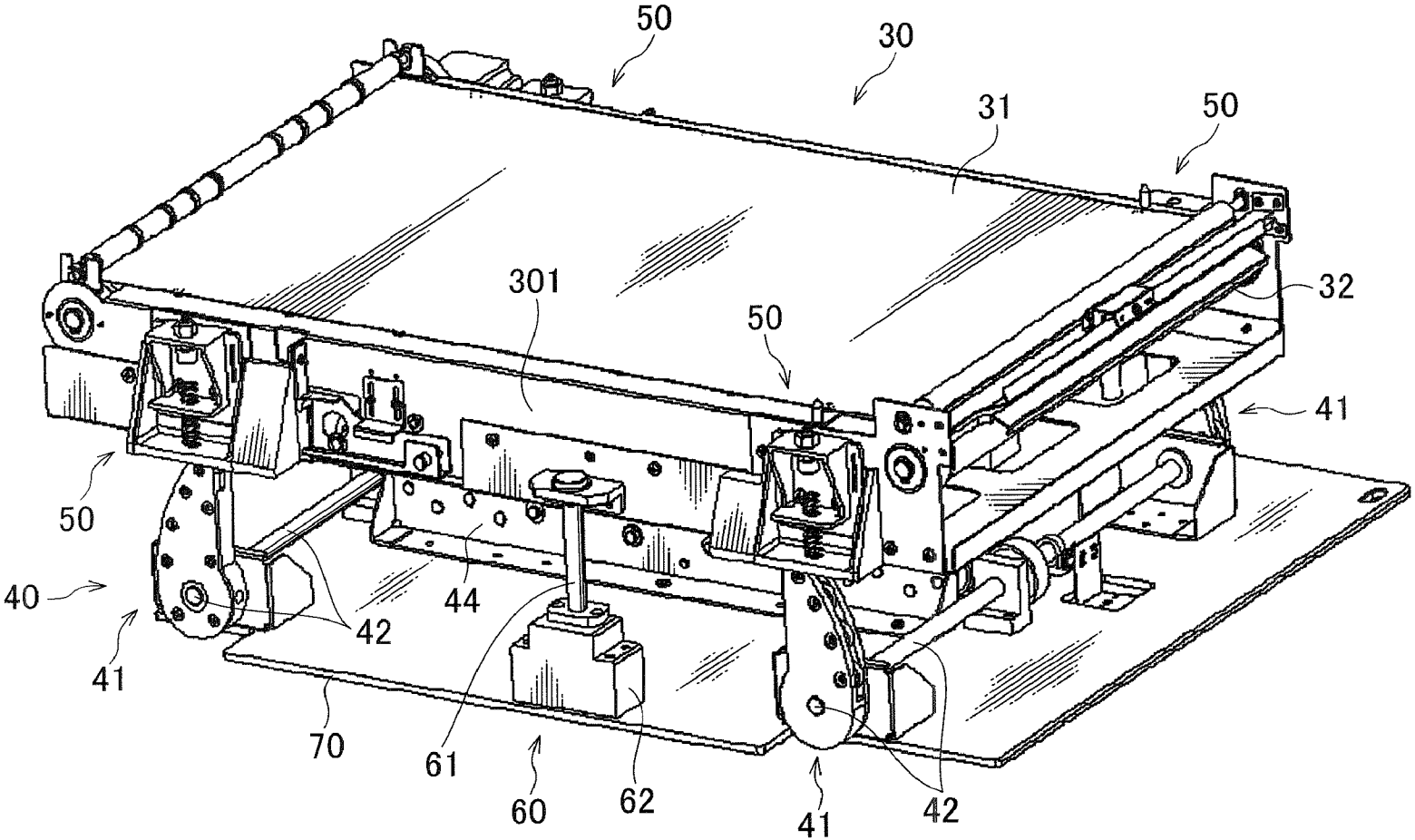
FIG. 12 is a perspective view showing a conveyance unit and an elevator according to the second embodiment.
Figure 13:
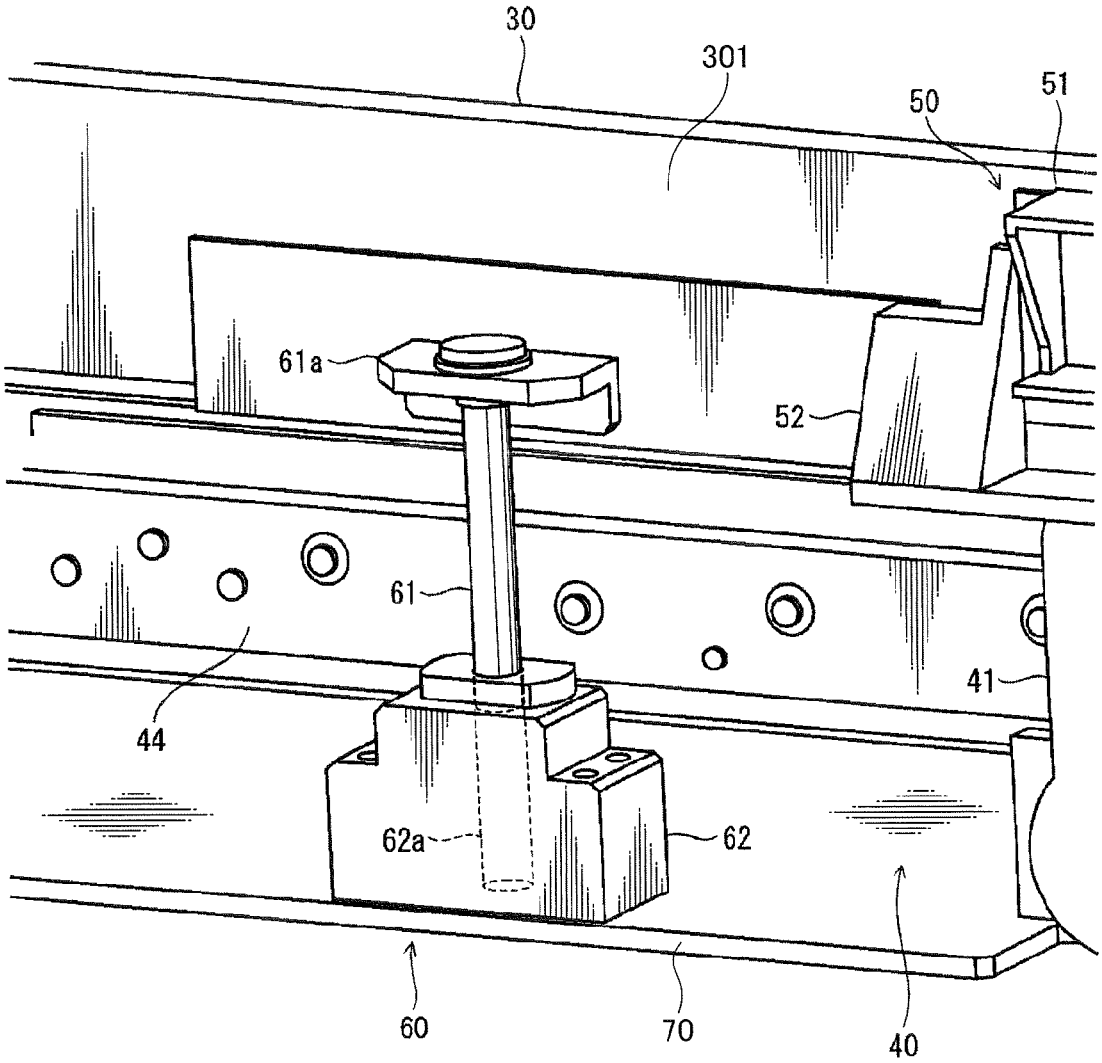
FIG. 13 is a partial perspective view showing a guiding mechanism and its periphery.

FIG. 12 is a perspective view of the conveyance unit 30 and the elevator 40 provided with the guiding mechanisms 60, and FIG. 13 is a partial perspective view showing the periphery of the guiding mechanism 60. FIG. 12 shows longitudinal parts of the shaft portions 42 of the eccentric cams 41 and a gear mechanism 44 for transmitting torques to the shaft portions 42, which are not shown in FIG. 2.

The guiding mechanisms 60 are for guiding vertical movements of the conveyance unit 30. The guiding mechanisms 60 are respectively arranged between the two eccentric cams 41 on the front surface of the conveyance unit 30 and between the two eccentric cams 41 on the rear surface of the conveyance unit 30. Each guiding mechanism 60 includes a guide pin 61 (sliding member) and a pin receiving member 62 (guiding member) engageable with the guide pin 61.

As shown in FIGS. 12 and 13, the guide pin 61 is fixed to a first side plate 301 on the front surface of the conveyance unit 30 (and to the second side plate 302 on the rear surface) via an L-shaped fixing member 61*a* (although the rear side is not shown, the guide pin 61 is similarly fixed to the second side plate 302). Each guide pin 61 is cylindrical and extends vertically downward.

The pin receiving members 62 are mounted on and fixed to a frame 70 of the apparatus main body 2 at positions corresponding to the guide pins 61. Each pin receiving member 62 is formed with a guide hole 62*a* that is so dimensioned as to receive the guide pin 61 and engageable with the guide pin 61. The guide hole 62*a* extends in vertical direction (penetrates the pin receiving member 62). The pin receiving members 62 are fixed to the frame 70 of the apparatus main body 2 by tightening screws 62*b* shown in FIG. 14 from below.

Figure 14:
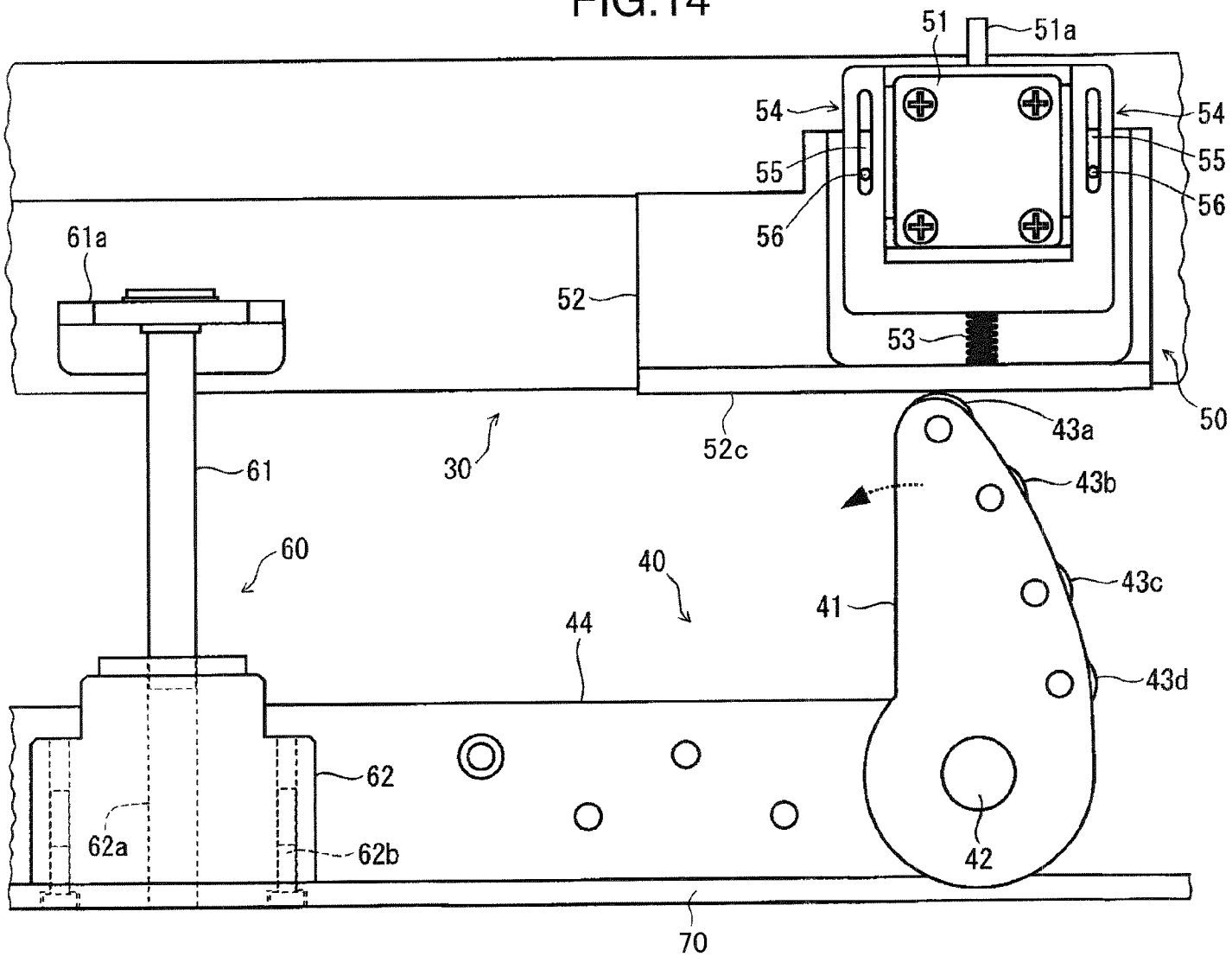
FIG. 14 is a partial enlarged front view of the elevator and its periphery shown in FIG. 12, FIGS. 15 to 18 are partial enlarged front views of the elevator and its periphery shown in FIG. 12 successively showing a state where the conveyance unit is gradually lowered.

Next, elevating and lowering movements of the conveyance unit 30 according to the second embodiment are described with reference to FIGS. 14 to 18. FIG. 14 is a partial enlarged front view of the elevator 40, the guiding mechanism 60 and their periphery. FIGS. 15 to 18 are also partial enlarged front views of the elevator 40, the guiding mechanism 60 and their periphery, successively showing a state where the conveyance unit 30 is gradually lowered. FIG. 14 shows a state where the conveyance unit 30 is elevated to a highest position (the upper surfaces of the pins 51*a* of the supporting members 50 of the conveyance unit 30 are in contact with the bottom surface of the recording device 20) by the elevator 40. In the second embodiment, the eccentric cam 41 has four bearings 43*a* to 43*d*.

In a normal printing state, a controller (not shown) of the printer 1A causes an unillustrated motor to operate, thereby driving the shaft portions 42 of the gear mechanisms 44 to rotate the eccentric cams 41 and to move the conveyance unit 30 to the highest position. In this state, a clearance suitable for printing is defined between the bottom surface of the recording device 20 and the upper surface of the conveyance unit 30 (see FIG. 11). At this time, the first bearings 43*a* of the eccentric cams 41 arranged at positions most distant from the rotation axis lines in the centers of the shaft portions 42 are in contact with the contact surfaces 52*c* of the sliding portions 52 of the supporting members 50 provided in the conveyance unit 30 from below.

When the conveyance unit 30 is lowered by the elevator 40, the motor of the elevator 40 is driven by the controller to rotate the eccentric cams 41. In the case of lowering the conveyance unit 30, the eccentric cams 41 located at the upstream side of the conveyance unit 30 in the sheet conveying direction rotate counterclockwise and those located at the downstream side rotate clockwise when viewed from front. As the eccentric cams 41 rotate, the first bearings 43*a* roll on the contact surfaces 52*c* and the eccentric cams 41 move as if they were sliding in the horizontal planes of the contact surfaces 52*c*, whereby the lowering movement of the conveyance unit 30 is started.

Figure 15:
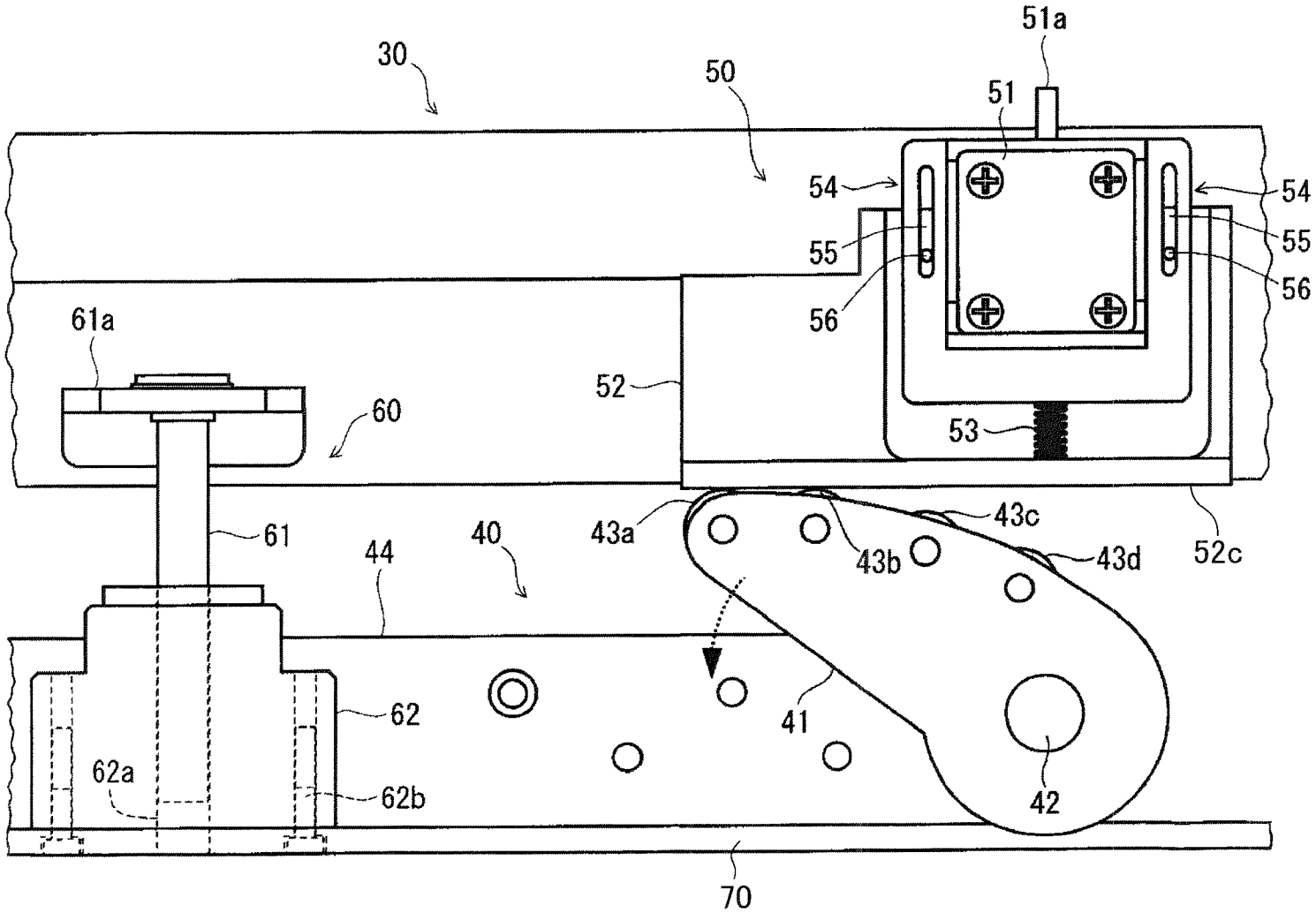

FIGS. 14 to 18 show the movement of the eccentric cam 41 located at the upstream side in the sheet conveying direction in FIG. 12. If the eccentric cam 41 is rotated counterclockwise to lower the conveyance unit 30 in the state of FIG. 14, the second bearing 43*b* arranged at a position closer to the rotation axis line than the first bearing 43*a* comes into contact with the contact surface 52*c* of the sliding portion 52, i.e. the bottom surface of the conveyance unit 30 as shown in FIG. 15, following the first bearing 43*a*. In this way, the two adjacent bearings 43*a*, 43*b* have a period during which they are simultaneously in contact with the bottom surface of the conveyance unit 30.

The lowering movement, i.e. vertical movement of the conveyance unit 30 is guided by the guiding mechanisms 60. In other words, the guide pins 61 are lowered while being guided by the guide holes 62*a* of the pin receiving members 62. Accordingly, the conveyance unit 30 moves vertically downward without being horizontally displaced by the action of the guiding mechanisms 60.

Figure 16:
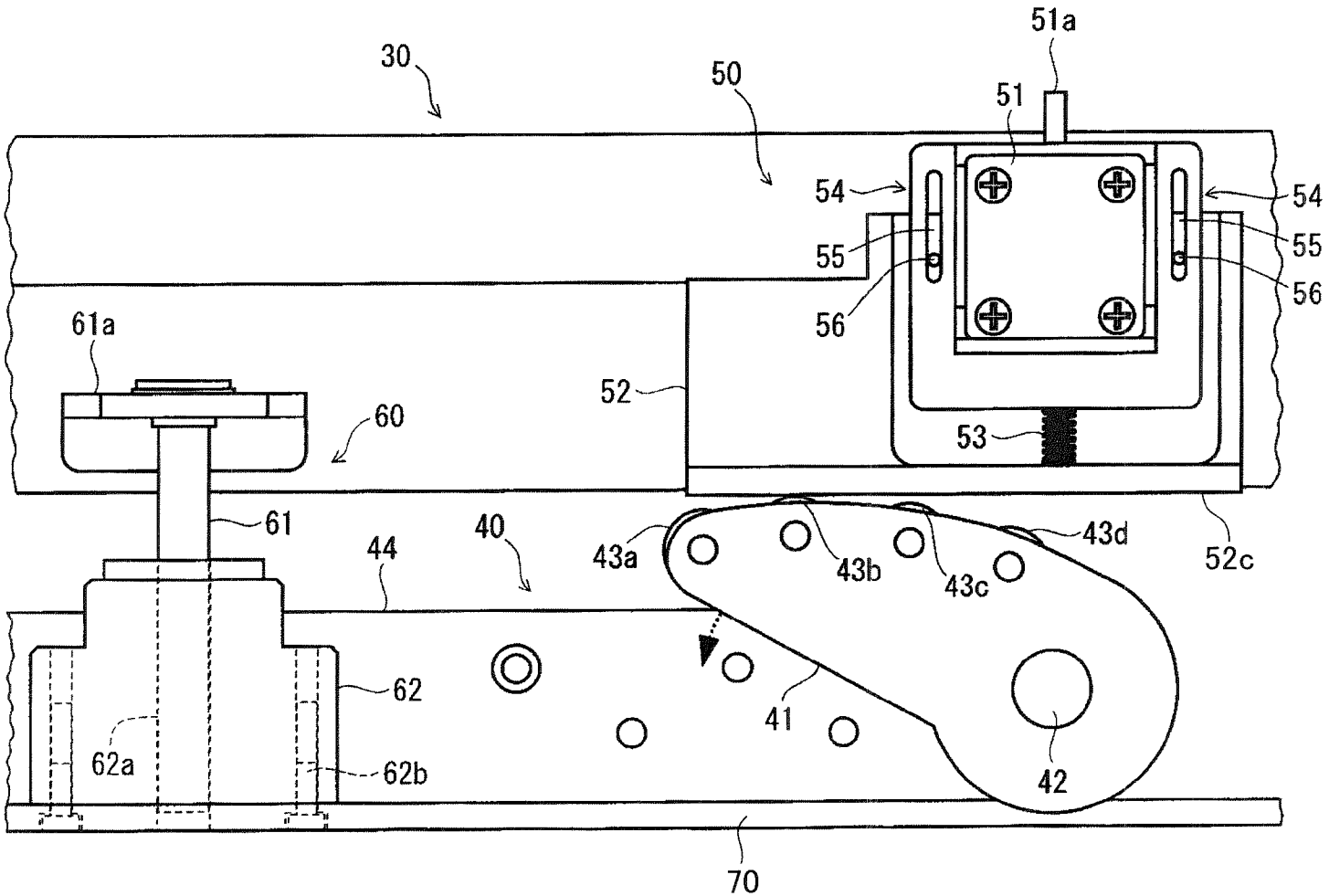

As the eccentric cam 41 is further rotated, the second bearing 43*b* alone comes into contact with the bottom surface (contact surface 52*c*) of the conveyance unit 30 to support the conveyance unit 30 as shown in FIG. 16.

Figure 17:
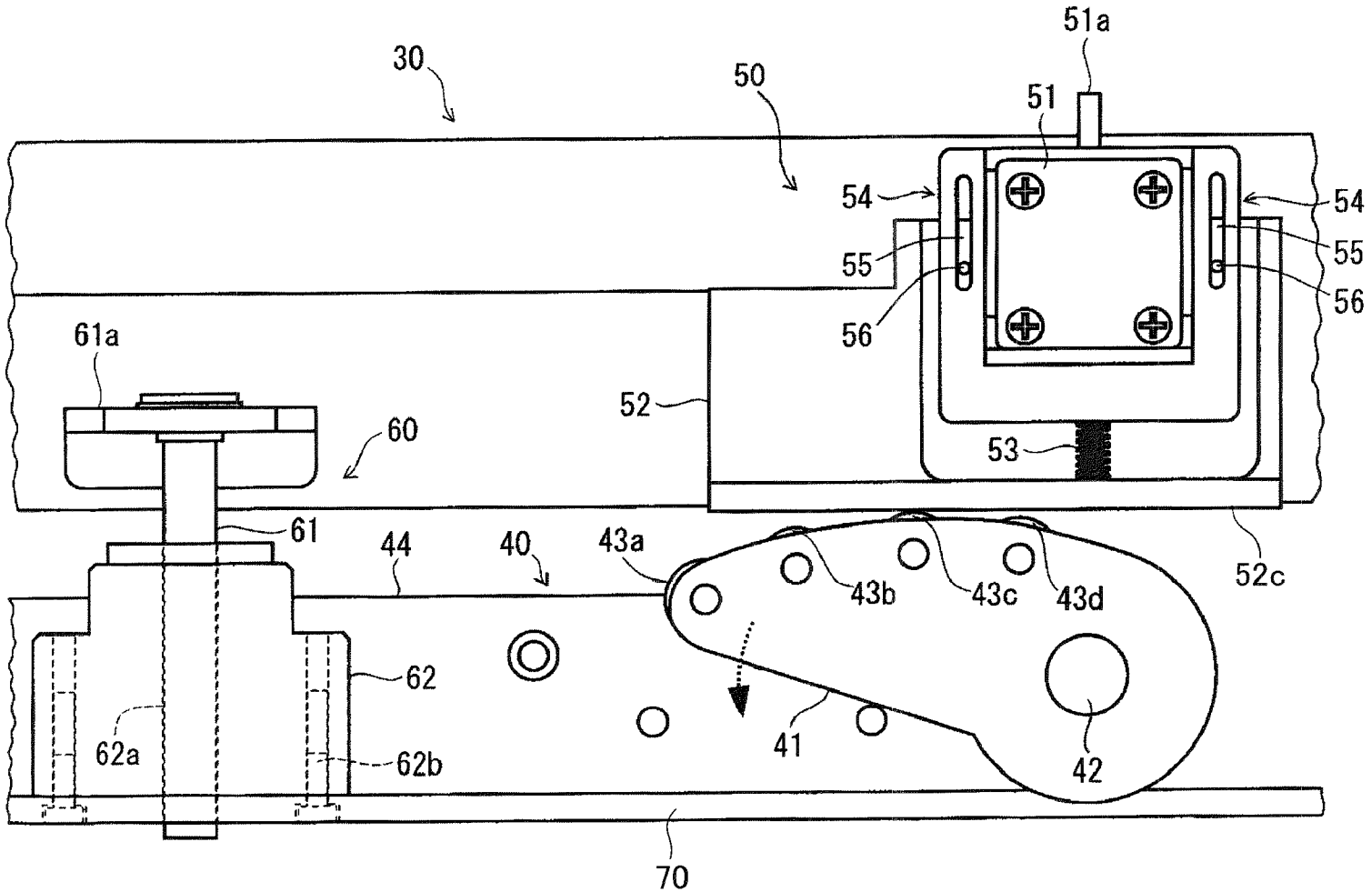

As the eccentric cam 41 is successively rotated, the third bearing 43*c* comes into contact with the bottom surface of the conveyance unit 30 to support the conveyance unit 30 as shown in FIG. 17. As in the case of the first and second bearings 43*a*, 43*b*, the adjacent second and third bearings 43*b*, 43*c* also have a period during which they are simultaneously in contact with the bottom surface of the conveyance unit 30.

Figure 18:
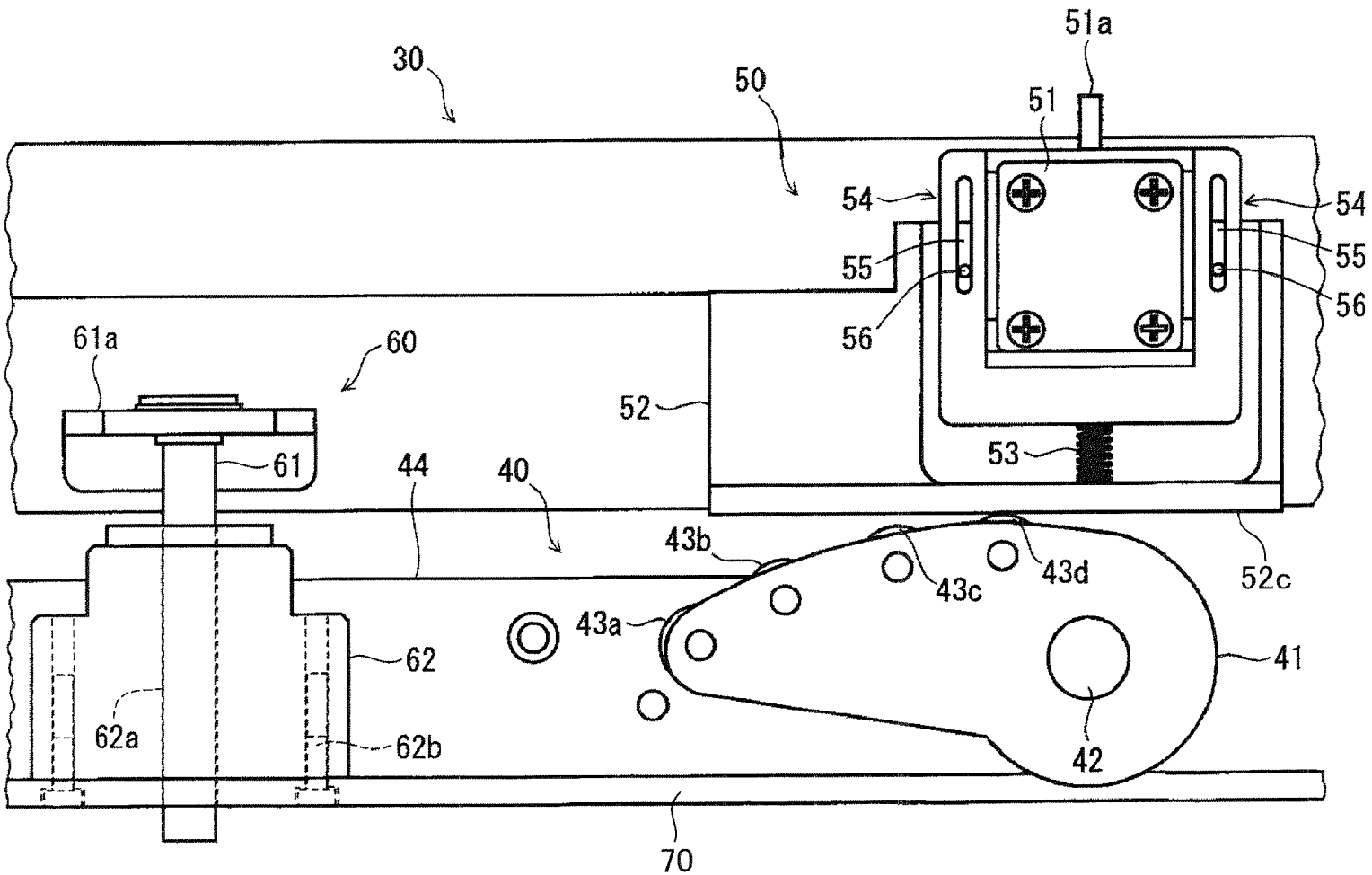

As the eccentric cam 41 is further rotated to reach a final stage of the lowering movement of the conveyance unit 30, the fourth bearing 43*d* arranged at a position closest to the rotation axis line of the eccentric cam 41 alone comes into contact with the bottom surface of the conveyance unit 30 to support the conveyance unit 30 as shown in FIG. 18. In this way, the lowering movement of the conveyance unit 30 is completed and a relatively large operation space is defined between the recording device 20 and the conveyance unit 30.

Thereafter, in order to return the conveyance unit 30 to the position for normal printing, the conveyance unit 30 can be elevated to the state shown in FIG. 14 by rotating the eccentric cam 41 in a reverse direction, i.e. clockwise direction. At this time, the conveyance unit 30 can be vertically elevated without being horizontally displaced by the action of the guiding mechanisms 60.

As described above, since the guiding mechanisms 60 are provided in addition to the construction of the first embodiment according to the second embodiment, transverse displacements of the conveyance unit 30 can be hindered upon elevating and lowering the conveyance unit 30 by the elevator 40. Accordingly, the conveyance unit 30 can be smoothly moved upward and downward without being transversely displaced, thereby improving the positioning accuracy relative to the recording device 20 and preventing an occurrence of a sheet jam, with the result that the printer 1 capable of forming high-quality images can be provided.

Since each guiding mechanism 60 includes the guide pin 61 as a sliding member extending substantially in vertical direction and the pin receiving member 62 as a guiding member engageable with the guide pin 61, the conveyance unit 30 can be vertically moved upward and downward without being horizontally displaced by a simple construction. Thus, the conveyance unit 30 can be more accurately positioned relative to the recording device 20.

Specifically, there can be avoided an occurrence of a problem that the conveyance unit 30 is largely displaced in horizontal direction to make it impossible to insert the pins 51*a* of the supporting members 50 of the conveyance unit 30 into the engaging holes formed in the recording device 20 corresponding to the pins 51*a*, thereby being unable to accurately position the conveyance unit 30 relative to the recording device 20 to affect the image formation. Therefore, sheet conveyance suitable to improve the image quality and prevent an occurrence of a jam can be realized.

Since the guide pin 61 is cylindrical and the pin receiving member 62 is formed with the guide hole 62*a* into which the cylindrical guide pin 61 is fittable, the lightweight and high-strength guiding mechanism 60 can be obtained. Therefore, the positioning accuracy of the conveyance unit 30 relative to the recording device 20 can be further improved.

In each guiding mechanism 60, the guide pin 61 is fixed to the conveyance unit 30 and the pin receiving member 62 is fixed to the frame 70 of the apparatus main body 2. This configuration enables the guide pin 61 not to project upward from the conveyance unit 30. Thus, in the case where the conveyance unit 30 needs to be detached from the apparatus main body 2 for maintenance after being lowered by the elevator 40, the guiding mechanisms 60 can be prevented from hindering such a detachment. Therefore, maintenance operability can be improved in addition to the improvement in the positioning accuracy of the conveyance unit 30 relative to the recording device 20.

Figure 19:
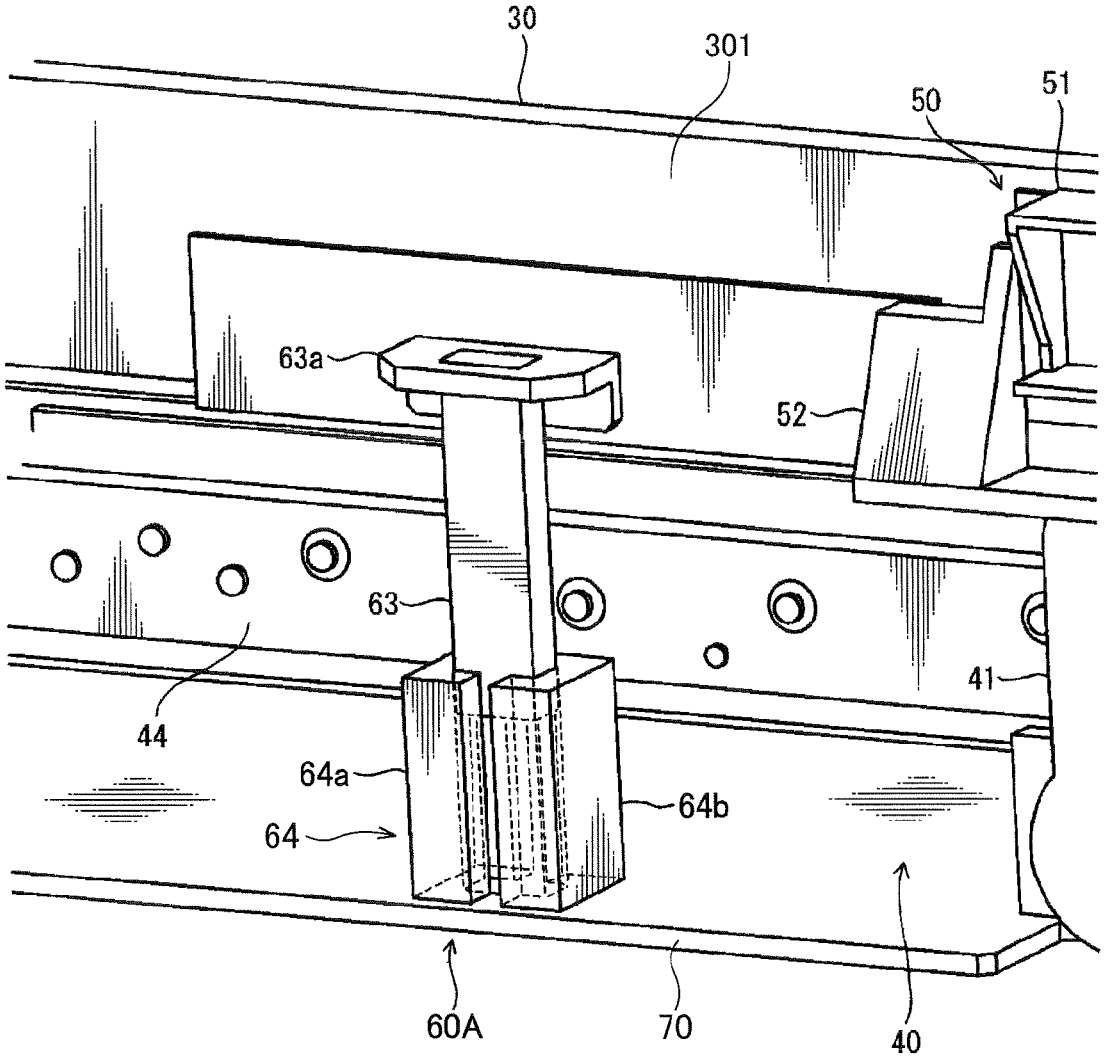
FIG. 19 is a partial perspective view showing a guiding mechanism and its periphery according to another embodiment.

Next, the construction of a guiding mechanism 60A according to a modification is described with reference to FIG. 19. FIG. 19 is a partial perspective view showing the periphery of the guiding mechanism 60A. It should be noted that the basic construction of this modification is the same as the above embodiment described with reference to FIGS. 12 to 18.

The guiding mechanism 60A includes a guide rod 63 as a sliding member and a rod receiving member 64 as a guiding member engageable with this guide rod 63.

The guide rod 63 is fixed to the first side plate 301 on the front surface of the conveyance unit 30 (and to the second side plate 302 on the rear surface) via an L-shaped fixing member 63*a* (although the rear side is not shown, the guide rod 63 is similarly fixed to the second side plate 302). Each guide rod 63 is in the form of a rectangular parallelepiped and extends vertically downward.

The rod receiving members 64 are mounted on and fixed to the frame 70 of the apparatus main body 2 at positions corresponding to the guide rods 63. Each rod receiving member 64 is comprised of two blocks 64*a*, 64*b* having a U-shaped horizontal cross section, opposed to each other and extending in vertical direction. The guide rod 63 is guided while being held in a recess defined by this rod receiving member 64. The rod receiving members 64 are fixed to the frame 70 of the apparatus main body 2 by tightening screws (not shown) from below.

Since the guide rods 63 are guided while being held in the recesses of the rod receiving members 64 in the guiding members 60, the conveyance unit 30 can be prevented from rotating in a horizontal plane and the rod receiving members 64 can be easily arranged. Therefore, the guiding mechanisms 60A can be easily arranged in addition to the further improvement in the positioning accuracy of the conveyance unit 30.

The first and second embodiments of the present invention are described above, but the present invention is not limited to these in its scope and can be changed, for example as in (1) to (5) below without departing from the gist thereof.

In the above embodiments, the ink-jet printer is described as an example of the image forming apparatus. The image forming apparatus may be a laser printer for printing by transferring and fixing a toner image to a sheet.

The number of the bearings in each eccentric cam 41 is five in the first embodiment and four in the second embodiment. The number of the bearings 43 may be more or less than these, and the bearings 43 may be arranged at other positions. Further, the shape of the eccentric cams 41 themselves is not limited to the one of the above embodiments and another shape may be adopted.

Eccentric cams having no bearings may be used. In this case, the peripheral edges 411*a*, 412*a* of the pair of holding plates 411, 412 serve as cam surfaces in the eccentric cam 41 shown in FIG. 4. Thus, it is preferable to make the holding plates 411, 412 of a low friction material or to coat the peripheral edges 411*a*, 412*a* with low friction layers.

In the above embodiments, two supporting members 50 (positioning members) are provided on each of the first and second side plates 301, 302 of the conveyance unit 30. However, since three-point positioning is also possible, it may be, for example, such that two supporting members 50 are mounted on the first side plate 301 and one supporting member 50 is mounted on the second side plate 302. Alternatively, one supporting member 50 may be mounted on the first side plate 301 and two supporting members 50 may be mounted on the first side plate 302.

In the above embodiment, the contact surfaces 52*c* are set on the bottom surfaces of the sliding portions 52 of the supporting members 50. However, it is sufficient for the contact surfaces 52*c* to be set on the conveyance unit 30 or part(s) integral to the conveyance unit 30. For example, the eccentric cams 41 may come into contact with the bottom plate of the conveyance unit 30.

The specific embodiments described above mainly embrace inventions having the following constructions.

An image forming apparatus according to one aspect of the present invention comprises a recording device for printing a recording medium; a conveyance unit arranged below the recording device to face the recording device and adapted to convey the recording medium; and an elevator for moving the conveyance unit upward and downward, wherein the elevator includes an eccentric cam having an eccentrically located rotation axis line, and the conveyance unit has a contact surface to be held in contact with the circumferential surface of the eccentric cam and is moved upward and downward by the rotation of the eccentric cam.

According to this construction, since the conveyance unit is moved upward and downward by the rotation of the eccentric cam, the magnitudes of loads acting on the eccentric cam itself, the shaft portion thereof, and a driving device such as a motor for rotating the eccentric cam can be gradually and smoothly changed. This can suppress the sudden action of excessive loads upon starting the elevator. Thus, the deformation and breakage of the eccentric cam and the motor can be prevented. As a result, the conveyance unit can be smoothly moved upward and downward without generating excessive loads in the elevator, the durability life can be improved and an image forming apparatus capable of forming high-quality images can be provided.

In the above construction, the eccentric cam preferably includes a plurality of rotatable members projecting at least partly outward from the circumferential surface of the eccentric cam to come into contact with the contact surface of the conveyance unit.

According to this construction, friction at contact portions of the eccentric cam and the conveyance unit can be reduced, thereby being able to reduce abrasion at the contact portions and smoothly move the conveyance unit upward and downward. Therefore, the durability life of the image forming apparatus can be improved and the conveyance unit can be stably moved upward and downward.

In this case, the plurality of rotatable members are preferably arranged in such an order of being gradually distanced from the rotation axis line of the eccentric cam.

According to this construction, the rotatable members can be successively brought into contact with the conveyance unit as the eccentric cam is rotated. Thus, the magnitudes of loads acting on the eccentric cam itself, the shaft portion thereof, and a driving device such as a motor for rotating the eccentric cam can be gradually and smoothly changed while friction at the contact portions of the eccentric cam and the conveyance unit is reduced. Therefore, the durability life of the image forming apparatus can be further improved and stability in the elevating and lowering movements of the conveyance unit can be improved.

Further, two adjacent ones of the plurality of rotatable members preferably have a period during which they are simultaneously in contact with the contact surface of the conveyance unit in the rotation process of the eccentric cam.

According to this construction, there can be created such a state where at least one of the rotatable members is invariably held in contact with the conveyance unit. Thus, a situation where the conveyance unit directly touches the eccentric cam can be prevented. Therefore, the conveyance unit can be more smoothly moved upward and downward.

In the above construction, it is preferable that the eccentric cam includes a pair of holding plates and a plurality of bearings rotatably held by the pair of holding plates; that the bearings are held by the holding plates such that the outer circumferential surfaces thereof partly project outward from the end edges of the pair of holding plates and a line connecting most projecting parts of the outer circumferential surfaces of the respective bearings serves as a specified cam surface; and that the cam surface comes into contact with the contact surface of the conveyance unit.

According to this construction, the eccentric cam with the rotatable members partly projecting outward from the circumferential surface of the eccentric cam can be easily formed.

In the above construction, it is preferable that the conveyance unit includes a positioning member for positioning the conveyance unit relative to the recording device; and that the positioning member includes a fixing member having a pin projecting upward, a sliding member having the contact surface, engageable with the fixing member and vertically slidable, and a biasing member interposed between the fixing member and the sliding member.

According to this construction, the recording device and the conveyance unit can be perfectly kept in parallel to each other without requiring experience skill.

It is preferable to mount at least three positioning members on the conveyance unit. For example, the conveyance unit may include an endless belt for conveying the recording medium and a first side plate and a second side plate arranged at the opposite sides of the endless belt; and at least one positioning member may be mounted on each of the first and second side plates and at least a total of three positioning members may be mounted.

In the above construction, it is preferable to further comprise a guiding mechanism for guiding vertical movements of the conveyance unit.

According to this construction, by providing the guiding mechanism, transverse displacements of the conveyance unit can be prevented when the conveyance unit is moved upward and downward by the elevator. Therefore, positioning accuracy relative to the recording device can be improved and a jam of a recording medium can be prevented.

In this case, the guiding mechanism preferably includes a sliding member extending substantially in vertical direction and a guiding member engageable with the sliding member.

According to this construction, by a simple construction, the conveyance unit can be vertically moved upward and downward without being horizontally displaced. Therefore, the conveyance unit can be more accurately positioned relative to the recording device.

The sliding member may be cylindrical and the guiding member may be formed with a hole into which the cylindrical sliding member is fittable. Then, the lightweight and high-strength guiding mechanism can be obtained. Therefore, the conveyance unit can be even more accurately positioned relative to the recording device.

Alternatively, the sliding member may be in the form of a rectangular parallelepiped and the guiding member may include a pair of recesses arranged to sandwich the sliding member. Then, the conveyance unit can be prevented from rotating in a horizontal plane and the guiding member can be easily arranged.

In the above construction, it is preferable that the sliding member is fixed to the conveyance unit; and that the guiding member is fixed to an apparatus main body of the image forming apparatus.

According to this construction, the sliding member can be prevented from projecting a long distance upward from the apparatus main body. Thus, in the case where the conveyance unit needs to be detached from the apparatus main body for maintenance after being lowered by the elevator, the guiding mechanism can be prevented from hindering such a detachment. Therefore, maintenance operability can be improved in addition to the improvement in the positioning accuracy of the conveyance unit relative to the recording device.

In the above construction, it is one of preferred embodiments that the recording device includes a plurality of line-type inkjet heads and forms a color ink image on the recording medium.

An image forming apparatus according to another aspect of the present invention comprises a recording device for printing a recording medium; a conveyance unit arranged below the recording device to face the recording device and adapted to convey the recording medium; a positioning member integrally mounted on the conveyance unit for positioning the conveyance unit relative to the recording device; an elevator including an eccentric cam having an eccentrically located rotation axis line for moving the conveyance unit upward and downward, and a guiding mechanism for guiding vertical movements of the conveyance unit, wherein the positioning member has a contact surface to be held in contact with the circumferential surface of the eccentric cam, and the conveyance unit is moved upward and downward by the rotation of the eccentric cam while being guided by the guiding mechanism.

This application is based on patent application Nos. 2007-021053, 2007-104633 and 2007-157520 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

a recording device for printing a recording medium;

a conveyance unit arranged below the recording device to face the recording device and configured for conveying the recording medium; and an elevator for moving the conveyance unit upward and downward, wherein:

the elevator includes an eccentric cam having an eccentrically located rotation axis line, the eccentric cam has peripheral edges whose curvature change as the eccentric cam is rotated about the rotation axis line, and a plurality of rotatable members projecting at least partly outward from the peripheral edges of the eccentric cam to come into contact with a contact surface of the conveyance unit, and the conveyance unit has the contact surface to be held in contact with the peripheral edges of the plurality of the rotatable members of the eccentric cam and is moved upward and downward by the rotation of the eccentric cam, the plurality of the rotatable members include a farthest rotatable member disposed at a farthest position from respect to the rotation axis line of the eccentric cam, a nearest rotatable member disposed at a nearest position from respect to the rotation axis line of the eccentric cam, and an intermediate rotatable member disposed between the farthest rotatable member and the nearest rotatable member, only the farthest rotatable member comes into contact with the contact surface of the conveyance unit when the conveyance unit is moved to an uppermost position, only the nearest rotatable member comes into contact with the contact surface of the conveyance unit when the conveyance unit is moved to a lowermost position, and only the intermediate rotatable member comes into contact with the contact surface of the conveyance unit for a certain period while the conveyance unit is being moved upward and downward.

2. An image forming apparatus according to claim 1, wherein the plurality of rotatable members are arranged in such an order of being gradually distanced from the rotation axis line of the eccentric cam.

3. An image forming apparatus according to claim 1, wherein two adjacent ones of the plurality of rotatable members have a period during which they are simultaneously in contact with the contact surface of the conveyance unit in the rotation process of the eccentric cam.

4. An image forming apparatus according to claim 1, wherein:

the eccentric cam includes a pair of holding plates and the plurality of rotatable members comprise a plurality of bearings rotatably held by the pair of holding plates;

the bearings are held by the holding plates such that the outer circumferential surfaces thereof partly project outward from the end edges of the pair of holding plates and a line connecting most projecting parts of the outer circumferential surfaces of the respective bearings serves as a specified cam surface; and the cam surface comes into contact with the contact surface of the conveyance unit.

5. An image forming apparatus according to claim 1, wherein:

the conveyance unit includes a positioning member for positioning the conveyance unit relative to the recording device; and the positioning member includes:

a fixing member having a pin projecting upward, a sliding member having the contact surface, the sliding member is engageable with the fixing member and vertically slidable, and a biasing member interposed between the fixing member and the sliding member.

6. An image forming apparatus according to claim 5, wherein at least three positioning members are mounted on the conveyance unit.

7. An image forming apparatus according to claim 6, wherein:

the conveyance unit include an endless belt for conveying the recording medium and a first side plate and a second side plate arranged at the opposite sides of the endless belt; and at least one positioning member is mounted on each of the first and second side plates and at least a total of three positioning members are mounted.

8. An image forming apparatus according to claim 1, further comprising a guiding mechanism for guiding vertical movements of the conveyance unit.

9. An image forming apparatus according to claim 8, wherein the guiding mechanism includes a sliding member extending substantially in vertical direction and a guiding member engageable with the sliding member.

10. An image forming apparatus according to claim 9, wherein:

the sliding member is cylindrical; and the guiding member is formed with a hole into which the cylindrical sliding member is fittable.

11. An image forming apparatus according to claim 9, wherein:

the sliding member is in the form of a rectangular parallelepiped; and the guiding member includes a pair of recesses arranged to sandwich the sliding member.

12. An image forming apparatus according to claim 9, wherein:

the sliding member is fixed to the conveyance unit; and the guiding member is fixed to an apparatus main body of the image forming apparatus.

13. An image forming apparatus according to claim 1, wherein the recording device includes a plurality of line-type inkjet heads and forms a color ink image on the recording medium.

14. An image forming apparatus, comprising:

a recording device for printing a recording medium;

a conveyance unit arranged below the recording device to face the recording device and configured for conveying the recording medium;

at least three positioning members integrally mounted on the conveyance unit for positioning the conveyance unit relative to the recording device;

an elevator including an eccentric cam having an eccentrically located rotation axis line to move the conveyance unit upward and downward; and a guiding mechanism disposed for each of the positioning members for guiding vertical movements of the conveyance unit, wherein:

the eccentric cam has peripheral edges whose curvatures change as the eccentric cam is rotated about the rotation axis line, the positioning members each have:

a fixing member having a pin projecting upward, a sliding member having a contact surface, wherein the contact surface is to be held in contact with the peripheral edge of the eccentric cam, the sliding member is engageable with the fixing member and vertically slidable, and a biasing member interposed between the fixing member and the sliding member; and the conveyance unit is moved upward and downward by the rotation of the eccentric cam while being guided by the guiding mechanism.

15. An image forming apparatus, comprising:

a recording device for printing a recording medium;

a conveyance unit arranged below the recording device to face the recording device and configured for conveying the recording medium;

a positioning member included in the conveyance unit for positioning the conveyance unit relative to the recording device; and an elevator for moving the conveyance unit upward and downward, wherein the elevator includes an eccentric cam having an eccentrically located rotation axis line, the conveyance unit has a contact surface to be held in contact with a circumferential surface of the eccentric cam and is moved upward and downward by the rotation of the eccentric cam, the positioning member includes a fixing member having a pin projecting upward, a sliding member having the contact surface, engageable with the fixing member and vertically slidable, and a biasing member interposed between the fixing member and the sliding member, and at least three positioning members are mounted on the conveyance unit.

16. The image forming apparatus according to claim 15, wherein the conveyance unit includes an endless belt for conveying the recording medium and a first side plate and a second side plate arranged at the opposite sides of the endless belt, and at least one positioning member is mounted on each of the first and second side plates and at least a total of three positioning members are mounted.

* * * * *